US008146523B2

(12) United States Patent
Matsumoto et al.

(10) Patent No.: US 8,146,523 B2
(45) Date of Patent: Apr. 3, 2012

(54) CIRCULAR STITCHING DEVICE FOR SEWING MACHINE

(75) Inventors: Nobuaki Matsumoto, Nagoya (JP); Yasuhiro Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 505 days.

(21) Appl. No.: 12/457,784

(22) Filed: Jun. 22, 2009

(65) Prior Publication Data

US 2009/0320730 A1 Dec. 31, 2009

(30) Foreign Application Priority Data

Jun. 26, 2008 (JP) ..... 2008-167230

(51) Int. Cl.
*D05B 39/00* (2006.01)

(52) U.S. Cl. ..... 112/470.17

(58) Field of Classification Search ..... 112/470.17, 112/470.14, 470.11, 136, 308
See application file for complete search history.

(56) References Cited

U.S. PATENT DOCUMENTS

| | | | | |
|---|---|---|---|---|
| 2,717,566 | A | 9/1955 | Szczepanski et al. | |
| 3,374,753 | A * | 3/1968 | Rakacs | 112/470.17 |
| 3,410,237 | A * | 11/1968 | Hanyu | 112/102 |
| 5,119,745 | A | 6/1992 | Terry | |
| 7,527,005 | B2 * | 5/2009 | Matsumoto et al. | 112/470.17 |
| 2008/0223276 | A1 | 9/2008 | Matsumoto et al. | |
| 2009/0320730 | A1 * | 12/2009 | Matsumoto et al. | 112/470.17 |
| 2010/0192824 | A1 * | 8/2010 | Matsumoto et al. | 112/470.17 |

FOREIGN PATENT DOCUMENTS

| | | |
|---|---|---|
| JP | U-57-179613 | 11/1982 |
| JP | U-60-191394 | 12/1985 |
| JP | U-62-23681 | 2/1987 |
| JP | U-62-23682 | 2/1987 |
| JP | U-63-148497 | 9/1988 |
| JP | U-1-158197 | 11/1989 |
| JP | U-4-375 | 1/1992 |
| JP | A-4-73086 | 3/1992 |
| JP | U-4-103875 | 9/1992 |
| JP | A-10-81089 | 3/1998 |
| JP | A-2008-253725 | 10/2008 |

* cited by examiner

*Primary Examiner* — Danny Worrell
*Assistant Examiner* — Larry Worrell, Jr.
(74) *Attorney, Agent, or Firm* — Oliff & Berridge, PLC

(57) ABSTRACT

A circular stitching device for a sewing machine includes a body base attachable to a sewing bed or an upper surface of a needle plate, a movable base located on the body base so as to be movable in a predetermined direction, a cloth fixing member including a cloth-fixing pin which is passable through a workpiece cloth and is formed with an engagement portion, and a holder holding a proximal end of the cloth-fixing pin, a cloth-fixing pin support detachably attachable to the movable base thereby to support the cloth fixing member so that the cloth fixing member is detachably attachable thereto, and a locking unit which is located on the cloth-fixing pin support and is disengageably engageable with the engagement portion of the cloth-fixing pin, thereby locking the cloth-fixing pin.

9 Claims, 17 Drawing Sheets

CIRCULAR STITCHING DEVICE FOR SEWING MACHINE

CROSS-REFERENCE TO RELATED APPLICATIONS

This application is based on and claims the benefit of priority from the prior Japanese Patent Application No. 2008-167230, filed on Jun. 26, 2008, the entire contents of which are incorporated herein by reference.

BACKGROUND

1. Field

The present disclosure relates to a circular stitching device for a sewing machine, which executes a circular stitching while a workpiece cloth is rotated about a cloth-fixing pin having passed through a workpiece cloth at a lateral position spaced away from a needle point.

2. Related Art

In execution of a circular stitching with use of a sewing machine, a circular stitching device fixed with a cloth-fixing pin is conventionally attached to the sewing machine, and a workpiece cloth is fixed at a single point spaced away from a needle position. A needlebar to which a sewing needle is attached is vertically moved while the workpiece cloth is turned about the cloth-fixing pin by feeding cloth by a feed dog, whereby the circular stitching is executed.

For example, Japanese Utility Model Application Publication No. JP-U-H04-103875 (hereinafter "patent document 1") discloses a circular pattern stitching device used in the above-described circular stitching. The disclosed circular pattern stitching device comprises a fixing member which is adapted to be fixed to a cloth table of a sewing machine and a support which is mounted on the fixing member so as to be slidable in a predetermined direction. The support is provided with a moving member which has a pin hole and is slidable in a predetermined direction. In execution of circular stitching, the support and the moving member are slid according to a size of a circle to be stitched, so that the location of the circular stitching device is adjusted. Subsequently, the cloth-fixing pin is inserted through the pin hole of the moving member from above so as to fix the workpiece cloth, thereby holding the workpiece cloth.

In the circular stitching device of patent document 1, however, the pin hole of the moving member is hidden from the user's sight below the underside of the workpiece cloth when the cloth-fixing pin is inserted through the pin hole. Accordingly, the user needs to insert the cloth-fixing pin through the pin hole with the cloth-fixing pin having been inserted through the workpiece cloth while looking into the space under the workpiece cloth. Thus, a work for fixing the cloth is difficult to carry out.

On the other hand, for example, Japanese Utility Model Application Publication No. JP-U-H04-375 (hereinafter "patent document 2") discloses a circular stitching instrument in which the cloth-fixing pin is mounted on the instrument body so as to be directed upward but not downward. More specifically, the circular stitching instrument comprises a pin support plate having an upwardly directed cloth-fixing pin and a movement block plate formed with three movement block holes. The pin support plate is attached to any one of the movement block holes, whereby the cloth-fixing pin is adjusted to the center of a circle to be stitched. According to this circular stitching instrument, the pin support plate is fitted into any one of the movement block holes after the cloth-fixing pin has been passed through the workpiece cloth in accordance with the center of the circle to be stitched. As a result, the cloth-fixing pin (the pin support plate) can be attached to the movement block plate more easily.

However, the pin support plate plays or gets rickety when a fit clearance between the movement block hole and the pin support plate is increased in order that the pin support plate may be attached to and detached from the movement block hole more easily. As a result, there is a possibility that a stitch end position may be displaced from a stitch start position. When the fit clearance is reduced so that the pin support plate is prevented from getting rickety, the pin support plate is attached to or detached from the movement block hole with increasing difficulty. Furthermore, since the pin support plate is attached to the movement block plate while the cloth-fixing pin is directed upward on the movement block plate, there is a possibility that the user or the like may touch the pin point with his/her finger tip.

SUMMARY

Therefore, an object of the present disclosure is to provide a circular stitching device in which the cloth-fixing pin can be attached to a cloth-fixing pin support easily without getting rickety and can be handled in safety without user's accidental touch with the cloth-fixing pin.

The present disclosure provides a circular stitching device for a sewing machine which executes a circular stitching while a workpiece cloth is turned about a cloth-fixing pin having passed through a workpiece cloth from above at a lateral position spaced away from a needle point by way of cloth feed by a feed dog, the circular stitching device comprising a body base which is attachable to a sewing bed or an upper surface of a needle plate, a movable base which is provided on the body base so as to be movable in a predetermined direction, a cloth fixing member which includes a cloth-fixing pin which is passable through a workpiece cloth and is formed with an engagement portion, and a holder holding a proximal end of the cloth-fixing pin, a cloth-fixing pin support which is detachably attachable to the movable base thereby to support the cloth fixing member so that cloth fixing member is detachably attachable thereto, and a locking unit which is provided on the cloth-fixing pin support and is disengageably engageable with the engagement portion of the cloth-fixing pin, thereby locking the cloth-fixing pin.

The cloth fixing member having the cloth-fixing pin is supported by the cloth-fixing pin support so as to be detachably attachable to the cloth-fixing pin support. The cloth-fixing pin support is detachably attachable to the movable base. Accordingly, the cloth-fixing pin of the cloth fixing member can easily be attached to the cloth-fixing pin support having been detached from the movable base at hand of the user while having passed through the workpiece cloth at the center of a circle to be stitched. Furthermore, in this case, the engagement portion of the cloth-fixing pin is locked by the locking unit, so that the cloth fixing member is attached to the cloth-fixing pin support. When the cloth-fixing pin is released from the engagement with the engagement portion by the locking unit, the cloth fixing member is allowed to be detached from the cloth-fixing pin support. Consequently, the cloth fixing member can reliably be attached to and detached from the cloth-fixing pin support.

BRIEF DESCRIPTION OF THE DRAWINGS

In the accompanying drawings.

DETAILED DESCRIPTION

Figure 1:
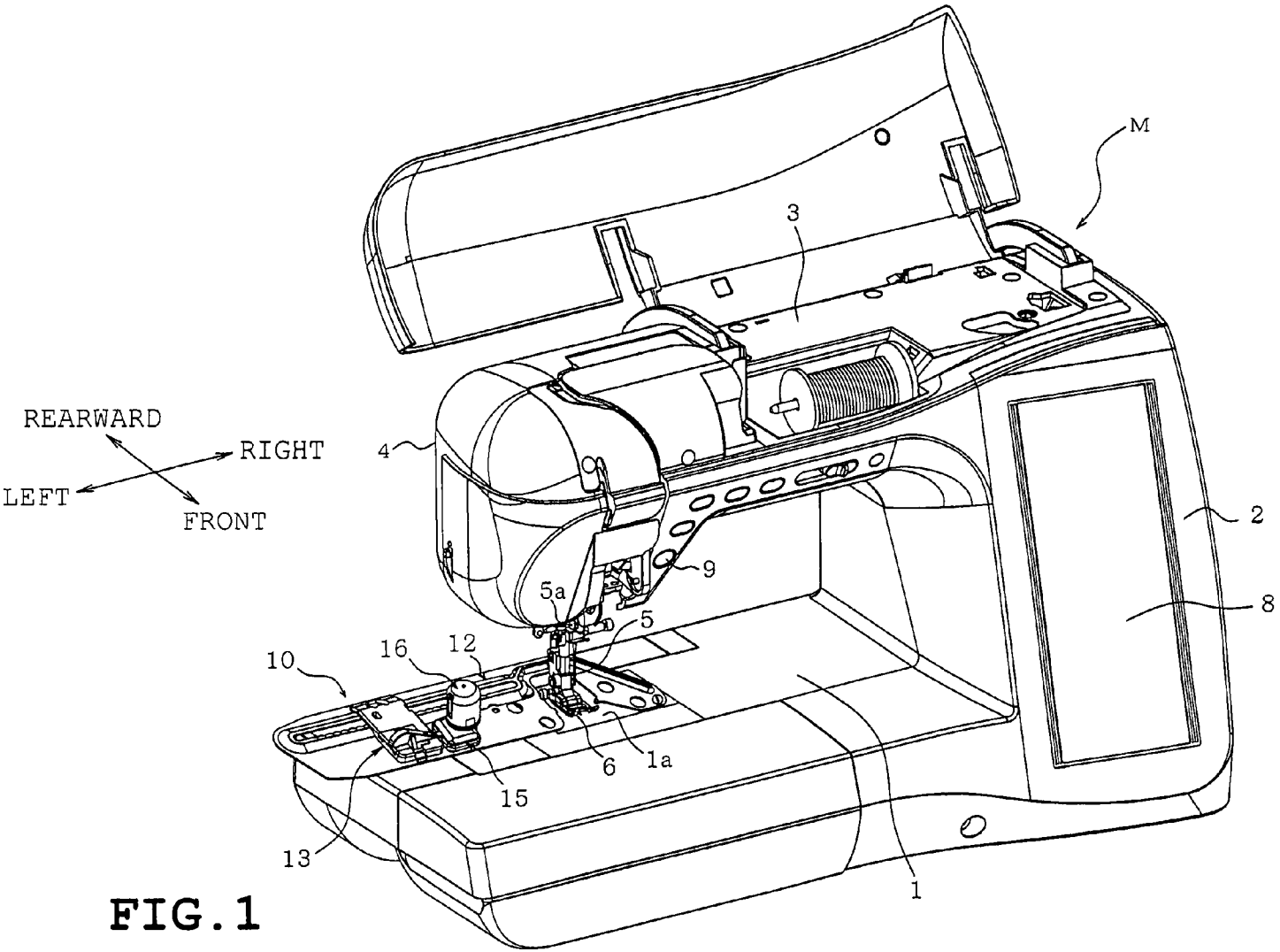
FIG. 1 is a perspective view of a sewing machine to which a circular stitching device of a first example is attached.

A first embodiment will be described with reference to FIGS. 1 to 13. Referring first to FIG. 1, a sewing machine M to which a circular stitching device of the first embodiment is attached is shown. In the following description, the user stands confronting the side of the sewing machine M including a liquid crystal panel.

The sewing machine M comprises a bed 1, a pillar 2 standing upward from a right end of the bed 1, an arm 3 extending leftward from an upper end of the pillar 2 so as to be opposed to the bed 1 and a head 4 provided on a left portion of the arm 3 all of which are formed integrally therewith. A main shaft (not shown) is provided so as to extend in the right-left direction in the arm 3. A sewing machine motor (not shown) is also provided in the arm 3 to rotate the main shaft.

A needlebar 5*a* is mounted on the head 4 and has a lower end to which a needle 5 is attached although the mounting manner is not shown in detail. A cloth presser 6 is disposed near the needle 5 to press a workpiece cloth CL (shown only in FIG. 11A) from above. A needlebar drive mechanism (not shown) is provided in the arm 3 to vertically move the needlebar 5*a* by the rotation of the main shaft. A needlebar swinging mechanism (not shown) is also provided in the arm 3 to swing the needlebar 5*a* in the direction (the right-left direction) intersecting a cloth feed direction. A needle thread take-up drive mechanism is further provided in the arm 3 to vertically move a needle thread take-up (not shown) in synchronization with the vertical movement of the needlebar 5*a* and the like.

A needle plate 1*a* is provided on an upper surface of the bed 1. Below the needle plate 1*a* are provided a feed dog vertically moving mechanism (not shown) vertically moving a feed dog 7 (see FIG. 2) which feeds the workpiece cloth CL to be processed, a full rotary hook which accommodates a bobbin (not shown) on which a bobbin thread is wound and forms stitches in cooperation with the needle 5, and a thread cutting mechanism (not shown) cutting a both needle thread and a bobbin thread. The needle plate 1*a* has a plurality of rectangular holes 1*b* into and out of which a plurality of teeth 7*a* of the feed dog 7 are retractable respectively. The needle plate 1*a* also has a wide curved needle hole 1*c* through which the needle 5 can pass.

A large-size color liquid-crystal display 8 is mounted on a front surface of the pillar 2. A menu screen, a pattern input screen, a pattern selecting screen and the like are displayed on the display 8. Various switches including a start/stop switch 9 instructing start and stop of a sewing operation are provided on the front surface of the arm 3. A circular stitching device 10 for executing a circular stitching is attached to an upper surface of the needle plate 1*a*. In the circular stitching device 10, a cloth-fixing pin 11 (see FIG. 5) is caused to pass through the workpiece cloth CL at a lateral position spaced away from the needle hole 1*c* serving as a needle point, and the needlebar 5*a* is vertically moved while the workpiece cloth CL is turned about the cloth-fixing pin 11 by the feed dog 7, whereby a circular stitching is carried out.

The circular stitching device 10 will now be described with further reference to FIGS. 2 to 4C as well as FIG. 1. The circular stitching device 10 includes a body base 12 which is detachably attachable to an upper surface of the needle plate 1*a*, a movable base 13 which is mounted on the body base 12 so as to be movable, a cloth fixing member 16 which includes a cloth-fixing pin 11, and a cloth-fixing pin support 15 which is detachably attachable to the movable base 13 thereby to support the cloth fixing member 16 so that cloth fixing member 16 is detachably attachable thereto.

Figure 2:
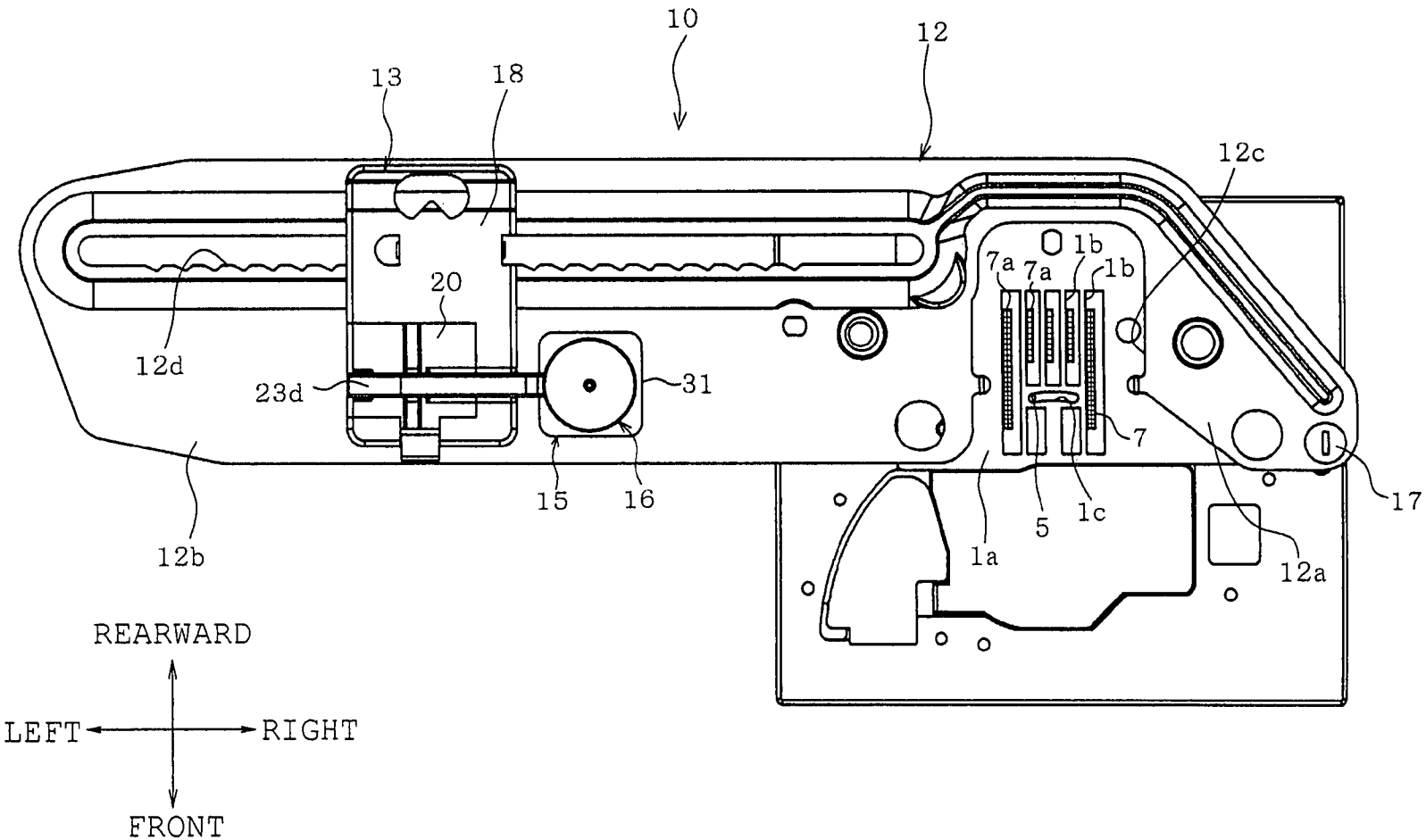
FIG. 2 is a plan view of the circular stitching device together with a needle plate.

The body base 12 has a mount 12*a* which is fixedly mounted on the needle plate 1*a* by a small screw 17 and a guide 12*b* which extends linearly from the mount 12*a* leftward, as shown in FIG. 2. The mount 12*a* and the guide 12*b* are formed integrally on the body base 12. The mount 12*a* is formed with an opening 12*c* which is open at the front side. The cloth presser 6 is disposed inside the opening 12*c*. The guide 12*b* is formed with a linear rail groove 12*d* extending in the right-left direction. A plurality of V-shaped grooves are formed in one side of the rail groove 12*d* at predetermined intervals (at intervals of 5 mm, for example).

Figure 3:
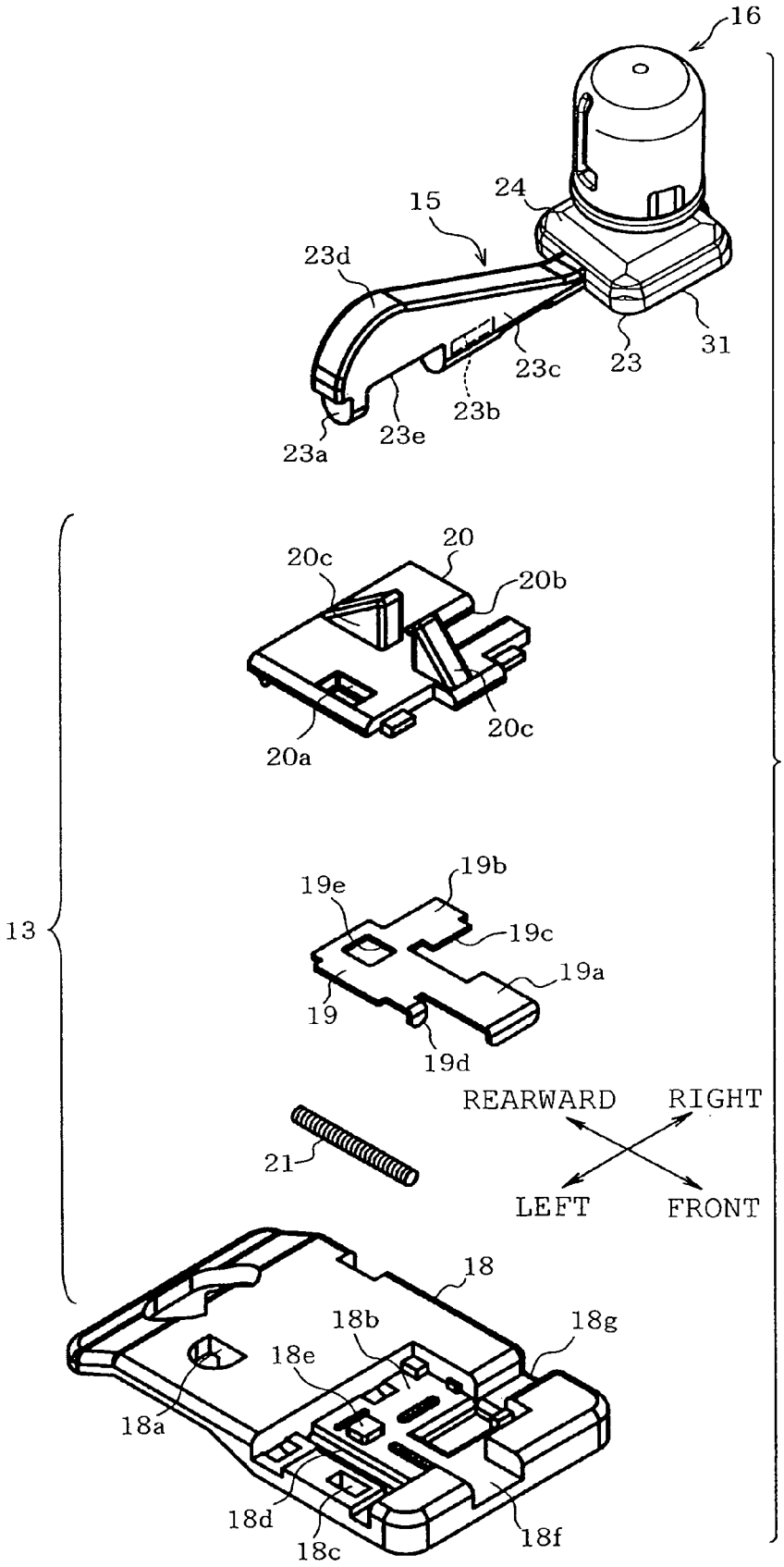
FIG. 3 is a perspective view of a cloth-fixing pin support, a cloth fixing member and an exploded movable base.
Figure 4C:
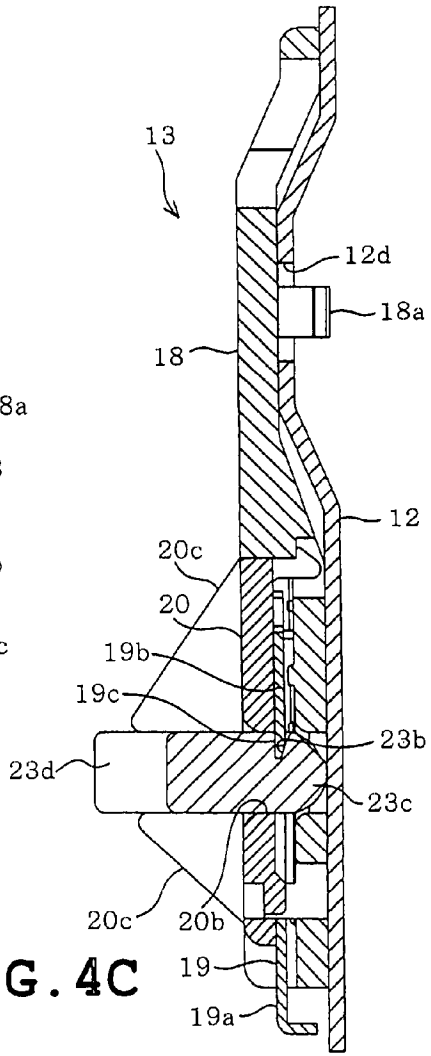
FIG. 4C is an enlarged section taken along line IVc-IVc in FIG. 4A.
Figure 4B:
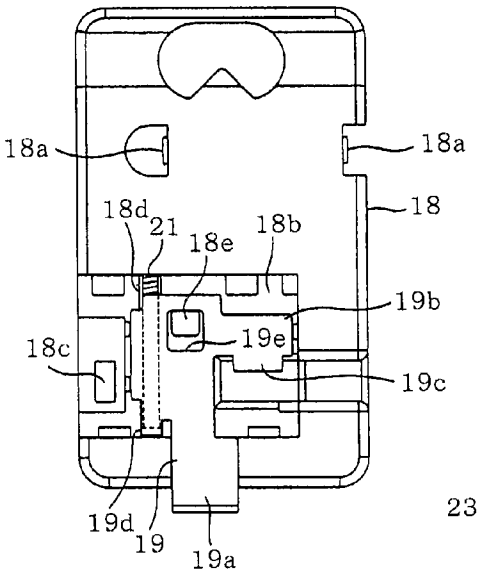
FIG. 4B is a plan view of the movable base from which an upper holder and the cloth-fixing pin support have been eliminated.
Figure 4A:
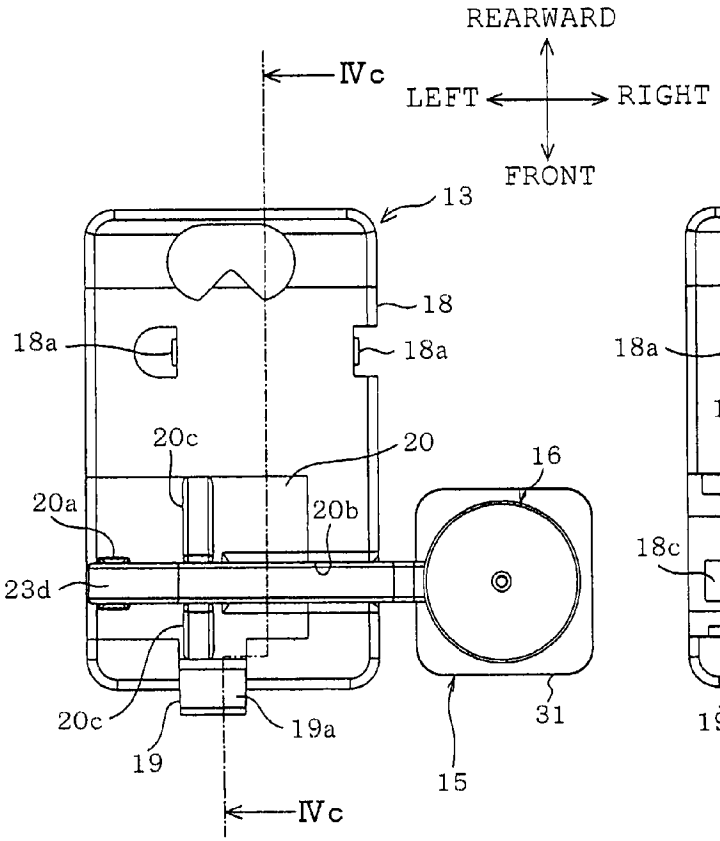
FIG. 4A is a plan view of the movable base, showing the cloth-fixing pin support attached to the movable base.

The movable base 13 has a lower movable holder 18, an operating plate 19 which is disposed so as to be slidable in the front-rear direction relative to the lower movable holder 18, an upper movable holder 20 which is disposed so as to cover the operating plate 19 from above and a compression coil spring 21 elongated in front-rear direction, as shown in FIG. 3. The lower movable holder 18 is formed substantially into a rectangular shape in planar view and has a rear portion formed with an engagement portion 18*a* (see FIGS. 4A to 4C) which is engageable with the rail groove 12*d* and protrudes to the underside. The lower movable holder 18 is movable along the rail groove 12*d* in the right-left direction, and the engagement portion 18*a* engages the rail groove 12*d* so that the movable holder 18 is supported at any position. Furthermore, when the lower movable holder 18 is moved in the right-left direction, the engagement portion 18*a* intermittently engages the V-shaped grooves provided at one side of the rail groove 12*d*, thereby imparting a light notch feeling. The lower movable holder 18 has a front upper surface formed with an accommodation recess 18*b* into which the operating plate 19 and the upper movable holder 20 are assembled. The accommodation recess 18*b* has a left end formed with a fitting hole 18*c* in which a fitting convexity 23*a* of the cloth-fixing pin support 15 is fitted as will be described later. A spring accommodating portion 18*d* is formed on the right of the fitting hole 18*c*. The compression coil spring 21 is accommodated in the spring accommodating portion 18*d*. A rectangular guide convex portion 18*e* is provided on the right of the spring accommodating portion 18*d*.

A concave operating plate guide 18*f* is formed in front of the accommodation recess 18*b* in the lower movable holder 18. The operating plate guide 18*f* guides an operating portion 19*a* of the operating plate 19 so that the operating portion 19*a* is movable in the front-rear direction. A concave cloth-fixing pin supporting portion 18*g* is formed on the right of the accommodation recess 18*b*. The cloth-fixing pin supporting portion 18*g* supports an engagement portion 23*c* (see FIG. 4C) of the cloth-fixing pin support 15 as will be described later. Both of the operating plate guide 18*f* and the cloth-fixing pin supporting portion 18*g* communicate with the accommodation recess 18*b*.

The operating plate 19 is formed substantially into an L-shape in planar view and has the operating portion 19*a* extending in the front-rear direction and an engaged portion 19*b* protruding rightward from a rear end of the operating portion 19*a*. The engaged portion 19*b* has a front end formed with an engagement claw 19*c* which engages an engagement groove 23*b* (see FIG. 4C) of the cloth-fixing pin support 15 as will be described later. A spring shoe 19*d* is located on the left of the operating portion 19*a* in the operating plate 19. The spring shoe 19*d* is bent downward and inserted into a front of the spring accommodating portion 18*d*.

The spring 21 has a front end that is in abutment with a rear face of the spring shoe 19*d* when the spring 21 is accommodated in the spring accommodating portion 18*d*. The spring 21 also has a rear end that is in abutment with a rear wall of the spring accommodating portion 18*d* when the spring 21 is accommodated in the spring accommodating portion 18*d*. The operating plate 19 is elastically urged forward by the spring force of the spring 21. The operating plate 19 has a rectangular guide hole 19*e* formed in the rear thereof. The guide convex portion 18*e* of the lower movable holder 18 is fitted in the guide hole 19*e*. The guide hole 19*e* has a cross-directional dimension that is set so as to be larger than a cross-directional dimension of the guide protrusion 18*e*. The operating plate 19 is movable in the front-rear direction by an amount corresponding to the difference between the cross-directional dimensions of the guide hole 19*e* and the guide protrusion 18*e* (see FIG. 4B).

The upper movable holder 20 is assembled into the accommodation recess 18*b* of the lower movable holder 18 while the operating plate 19 is interposed between the lower and upper movable holders 18 and 20. The upper movable holder 20 includes a left portion formed with a fitting hole 20*a* corresponding to the fitting grooves 18*c* of the lower movable holder 18. The upper movable holder 20 also includes a right portion formed with an opening 20*b* that is open at a right end of the upper movable holder 20. An engagement portion 23*c* of the cloth-fixing pin support 15 is to be fitted in the opening 20*b* as will be described later (see FIG. 4C). A central portion of the upper movable holder 20 includes parts corresponding to front and rear side walls of the opening 20*b*. A pair of generally triangular cloth sliding portions 20*c* in side view are formed on the parts of the upper movable holder 20 so as to be opposed to each other back and forth, respectively.

In attachment of the cloth-fixing pin support 15 to the movable base 13, the fitting convexity 23*a* is fitted into the fitting holes 20*a* and 18*c* of the respective upper and lower movable holders 20 in turn from above. The engagement portion 23*c* of the cloth-fixing pin support 15 is then fitted into the opening 20*b* of the upper movable holder 20. In this case, the elastic force of the spring 21 engages the engagement claw 19*c* of the operating plate 19 with the engagement groove 23*b* of the cloth-fixing pin support 15, whereby the cloth-fixing pin support 15 is prevented from upwardly coming off or is locked. Furthermore, front and rear faces of the cloth-fixing pin support 15 are abutted against the inner faces of the paired cloth-sliding portions 20*c* so that the cloth-fixing pin support 15 is supported so as not to fall down in the front-rear direction. On the other hand, when the cloth-fixing pin support 15 is detached from the movable base 13, the operating portion 19*a* of the operating plate 19 is pressed rearward against the urging force of the spring 21 so that the operating plate 19 is moved rearward. As a result, the engagement claw 19*c* is disengaged rearward from the engagement groove 23*b*, whereby the engagement claw 19 is released from engagement with the movable base 13. In this state, the cloth-fixing pin support 15 can be detached from the movable base 13 when lifted up. The above-described operating portion 19*a*, the engagement claw 19*c* and the spring 21 constitute a locking unit which locks the cloth-fixing pin support 15 so that the cloth-fixing pin support 15 is detachably held.

Figure 5:
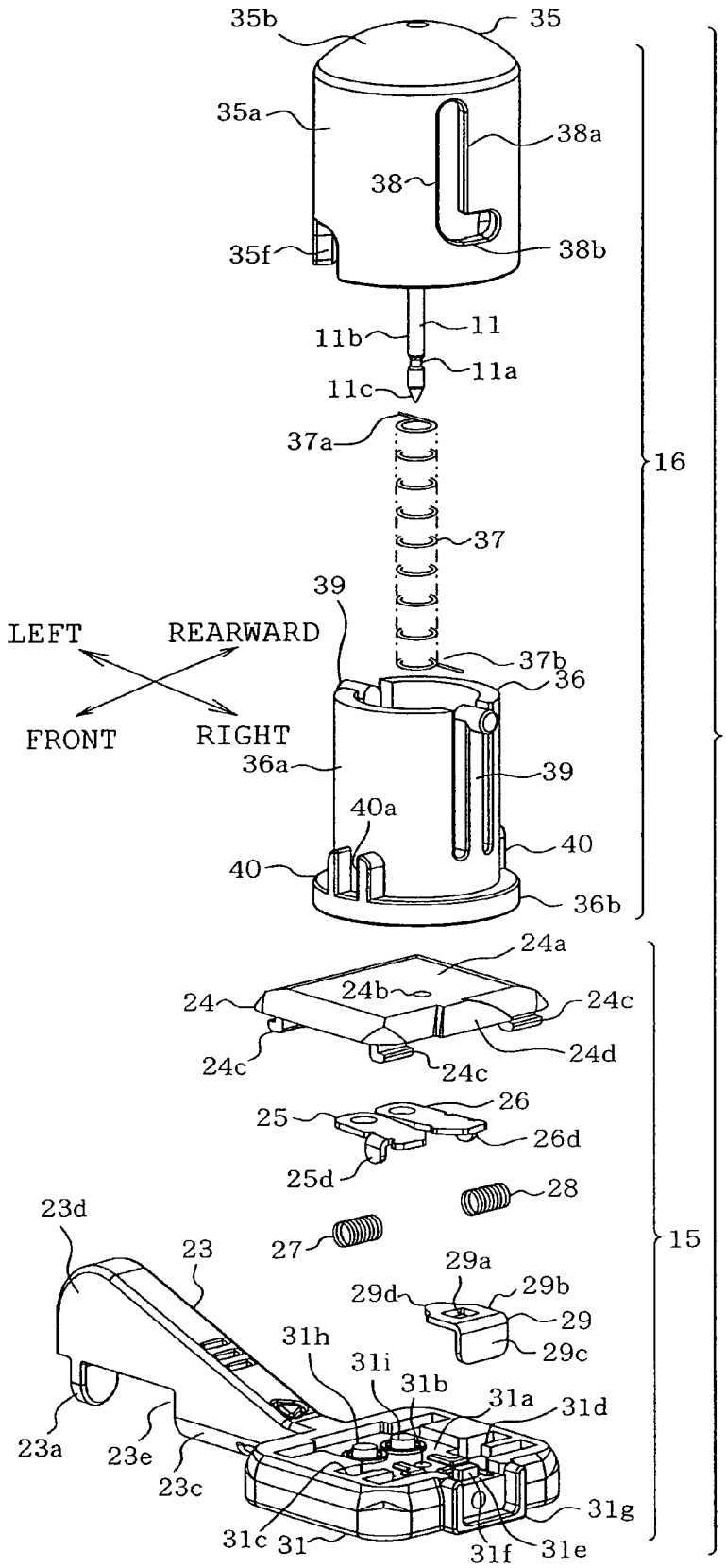
FIG. 5 is an exploded view of the cloth fixing member and the cloth-fixing pin support.

The cloth-fixing pin support 15 will be described with further reference to FIGS. 5 and 6 as well as FIGS. 1 to 4C. Referring to FIG. 5, the cloth-fixing pin support 15 comprises a lower pin holder 23, an upper pin holder 24, a plurality of engagement claws (two, for example) which are disposed so as to be accommodated in a space between the pin holders 23 and 24, compression coil springs 27 and 28 which are also disposed so as to be accommodated in the space between the pin holders 23 and 24, and the operating plate 29 which is disposed so as to be slidable relative to the lower pin holder 23.

The lower pin holder 23 has a grip 23*d* extending in the right-left direction, a body 31 formed into substantially a rectangular shape in planar view. The grip 23*d* is formed into such an inclined shape that the height of the lower pin holder 23 is gradually increased as the grip 23*d* extends leftward.

The lower pin holder 23 has a notch 23*e* formed in a lower portion of the grip 23*d*. The notch 23*e* is provided for assembling the cloth-fixing pin support 15 onto the movable base 13. The fitting convexity 23*a* is located just on the left of the notch 23*e*. An engagement groove 23*b* (see FIG. 4C) is formed in the rear surface located on the right of the notch 23*e* in the grip 23*e*. The engagement claw 19*c* of the operating plate 19 is to be fitted into the engagement groove 23*b*. The grip 23*d* has an engagement portion 23*c* located just on the right of the notch 23*e*. The grip 23*d* has a cross-directional dimension or width set so that the front and rear of the grip 23*d* are abutted against inner surfaces of the paired cloth-sliding portions 20*c* respectively.

Figure 6:
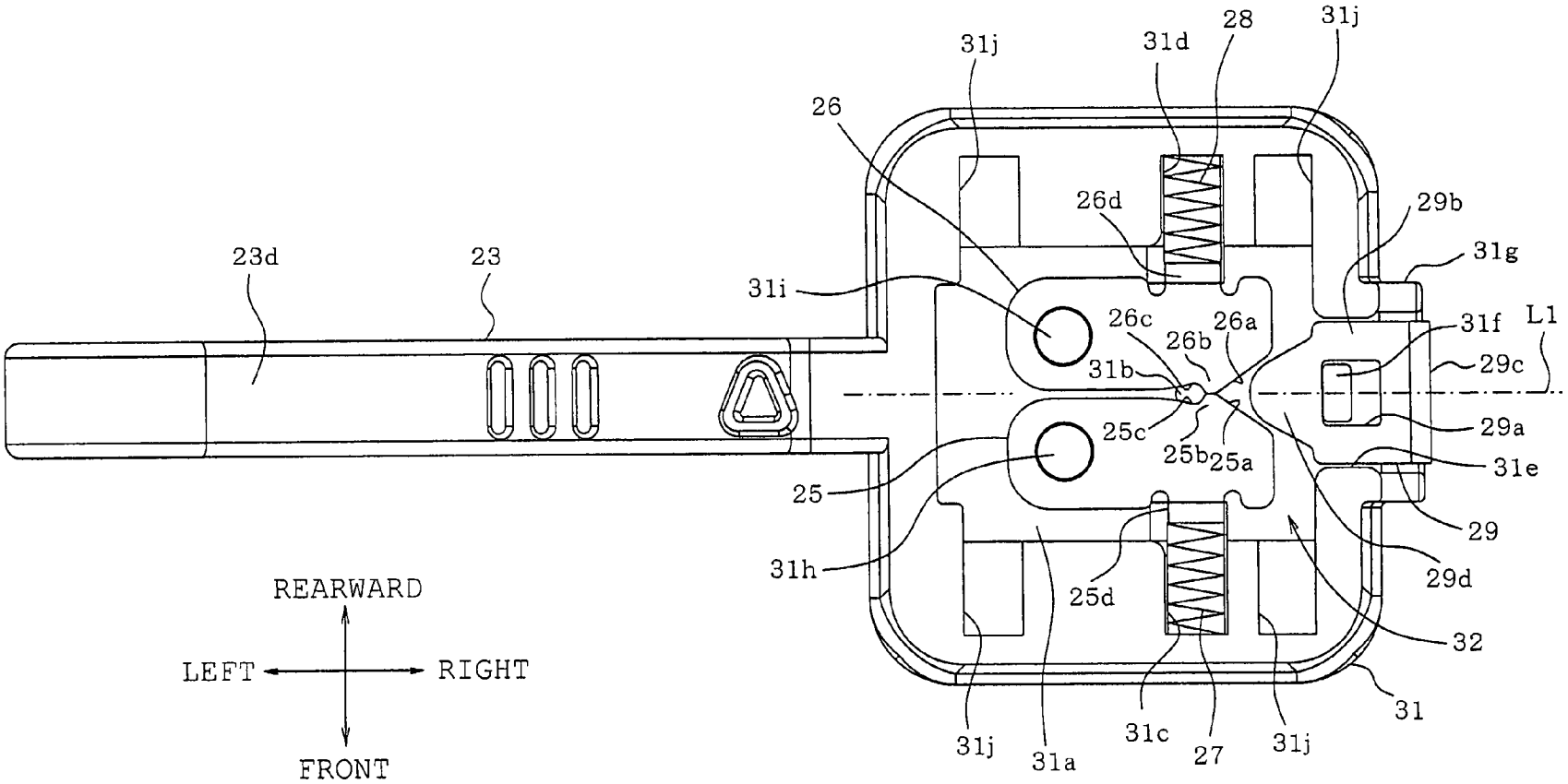
FIG. 6 is an enlarged plan view of the cloth-fixing pin support from which an upper pin holder is eliminated.

Referring now to FIGS. 5 and 6, an accommodation recess 31*a* is formed in the upper surface of the body 31 of the lower pin holder 23. The accommodation recess 31*a* is provided for assembling the engagement claws 25 and 26 and the operating plate 29. The accommodation recess 31*a* has an insertion hole 31*b* formed substantially in the center thereof. The insertion hole 31*b* allows the distal end of the cloth-fixing pin 11 to be inserted thereinto. The insertion hole 31*b* supports the cloth-fixing pin 11 on an outer circumference thereof, thereby preventing the cloth-fixing pin 11 from getting rickety.

The body 31 has spring accommodating portions 31*c* and 31*d* located at positions opposite to each other with the insertion hole 31*b* being interposed therebetween in planar view (see FIG. 6). The body 31 also has a concave operating plate guide 31*e* which is formed on the right of the accommodation recess 31*a* so as to communicate with the outside. The operating plate guide 31*e* guides the operating plate 29 in the right-left direction. The operating plate guide 31*e* is provided with a centrally located rectangular guide convex portion 31*f*. The body 31 has a right end provided with an auxiliary guide 31*g* protruding outward from the operating plate guide 31*e*. The auxiliary guide 31*g* is generally formed into a C-shape having an upper open end in a side view (see FIG. 5). The auxiliary guide 31*g* is formed so as to surround the periphery of the operating plate 29. The accommodation recess 31*a* is provided with two circular convex supports 31*h* and 31*i* both of which are located on the left of the insertion hole 31*b* and arranged before and after. The accommodation recess 31*a* of the body 31 has four corners provided with concave attaching portions 31*j* used to assemble the upper pin holder 24 respectively.

The operating plate 29 serving as an operating portion includes a guided portion 29*b* formed with a guide hole 29*a* and a pressing portion 29*c* formed by downwardly bending a right end of the guided portion 29*b*. The guide convex portion 31*f* of the body 31 is fitted in the guide hole 29*a*. The guide hole 29*a* has a horizontal dimension that is set so as to be longer than a horizontal dimension of the guide convex portion 31*f*. The operating plate 29 is movable in the right-left direction by an amount corresponding to the difference between the horizontal dimensions of the guide hole 29*a* and the guide convex portion 31*f* (see FIG. 6). The guided portion 29*b* has a left end formed with an angle spread portion 29*d*.

The engagement claws 25 and 26 extend in the right-left direction. The engagement claw 25 is supported on a front support 31*h* so as to be swingable, whereas the engagement claw 26 is supported on a rear support 31*i* so as to be swingable. The engagement claws 25 and 26 are disposed opposite to each other with a concave portion 11*a* of the cloth-fixing pin 11 being interposed therebetween and symmetrical, as shown in FIG. 6. More specifically, the engagement claws 25 and 26 have distal ends having inclined portions 25*a* and 26*a* formed along the spread portion 29*d* of the pressing portion 29*c* respectively. The engagement claws 25 and 26 are disposed so that a V-shape is formed by the inclined portions 25*a* and 26*a*.

The engagement claw 25 has an abutment portion 25*b* which is located at a valley of the V-shape and is formed so as to be abutable against the counterpart or engagement claw 26. The engagement claw 25 further has a fitting portion 25*c* which is located close to the abutment portion 25*b* and is formed so as to be fittable in the recess 11*a* of the cloth-fixing pin 11. The engagement claw 25 still further has a spring shoe 25*d* including a part facing the spring accommodating portion 31*c* and bent downward. The engagement claws 25 and 26 are symmetrical with each other about a straight line L1 (see FIG. 6) dividing the lower pin holder 23 into front and rear portions and passing through the center of the insertion hole 31*b*. Accordingly, the engagement claw 26 has an abutment portion 26*b* which is formed so as to be abutable against the counterpart or engagement claw 25, a fitting portion 26*c* which is formed so as to be fittable in the recess 11*a* of the cloth-fixing pin 11, and a spring shoe 26*d* facing the spring accommodating portion 31*d*, in the same manner as the engagement claw 25.

The compression coil spring 27 serving as a second elastic member is in abutment with the spring shoe 25*d* while being accommodated in the spring accommodating portion 31*d*. The compression coil spring 28 is also in abutment with the spring shoe 26*d* while being accommodated in the spring accommodating portion 31*a*. As a result, the engagement claws 25 and 26 are elastically urged by the respective compression coil springs 27 and 28 in such a direction that the recess 11*a* of the cloth-fixing pin 11 is interposed between the compression coil springs 27 and 28, thereby being in abutment with the abutment portions 25*b* and 26*b* respectively. On the other hand, the spread portion 29*b* of the operating plate 29 is slightly spaced from the inclined portions 25*a* and 26*a* while left sides of the guide hole 29*a* and a left side of the guide convex portion.

When the pressing portion 29*c* of the operating plate 29 is pressed leftward, the spread portion 29*d* of the operating plate 29 abuts against the inclined portions 25*a* and 26*a* of the engagement claws 25 and 26 and is moved leftward while being in sliding contact with the inclined portions 25*a* and 26*a*. In this case, the engagement claws 25 and 26 are adapted to be spread against the elastic forces of the compression coil springs 27 and 28 so that an angle between the inclined portions 25*a* and 26*a* is increased, respectively (see FIG. 13). A locking unit 32 is constituted by the foregoing engagement claws 25 and 26, the compression coil springs 27 and 28, and the operating plate 29.

The upper pin holder 24 is formed into a rectangular shallow box-shaped container and is constructed so as to cover an upper surface of the body 31 of the lower pin holder 23 as shown in FIG. 5. The upper pin holder 24 has a placement face 24*a* on which the workpiece cloth CL is to be placed and a through hole 24*b* formed through a substantially central part of the placement face 24*a*. The upper pin holder 24 has four corners provided with mounted portions 24*c* which engage the mounting portions 31*j* of body 31, respectively. The upper pin holder 24 has a right end formed with an overhang 24*d* which covers the upper surface of the pressing portion 29*c* of the operating plate 29. The overhang 24*d* surrounds the periphery of the pressing portion 29*c*, thereby preventing the pressing portion 29*c* from being inadvertently pressed.

The cloth fixing member 16 will now be described with reference to FIGS. 7A to 11B as well as to FIGS. 1 to 6. FIG. 9C illustrates the overall cloth fixing member 16. As shown in FIG. 9C, the cloth fixing member 16 comprises the cloth-fixing pin 11, a holder 35 which holds a proximal end of the pin 11, a covering member 36 which is movably mounted on the holder 35, and a compression coil spring 37 which is disposed so as to be accommodated in a space defined between the holder 35 and the covering member 36.

Figure 11A:
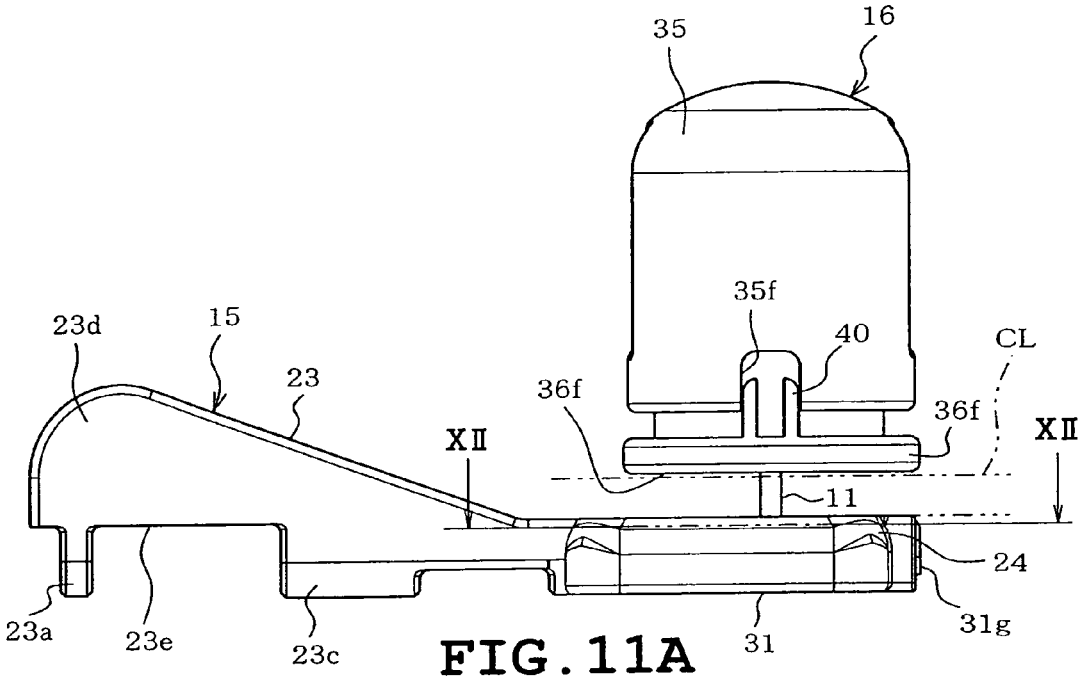
FIG. 11A is a front view of the cloth fixing member and the cloth-fixing pin support to which the cloth fixing member is attached.
Figure 11B:
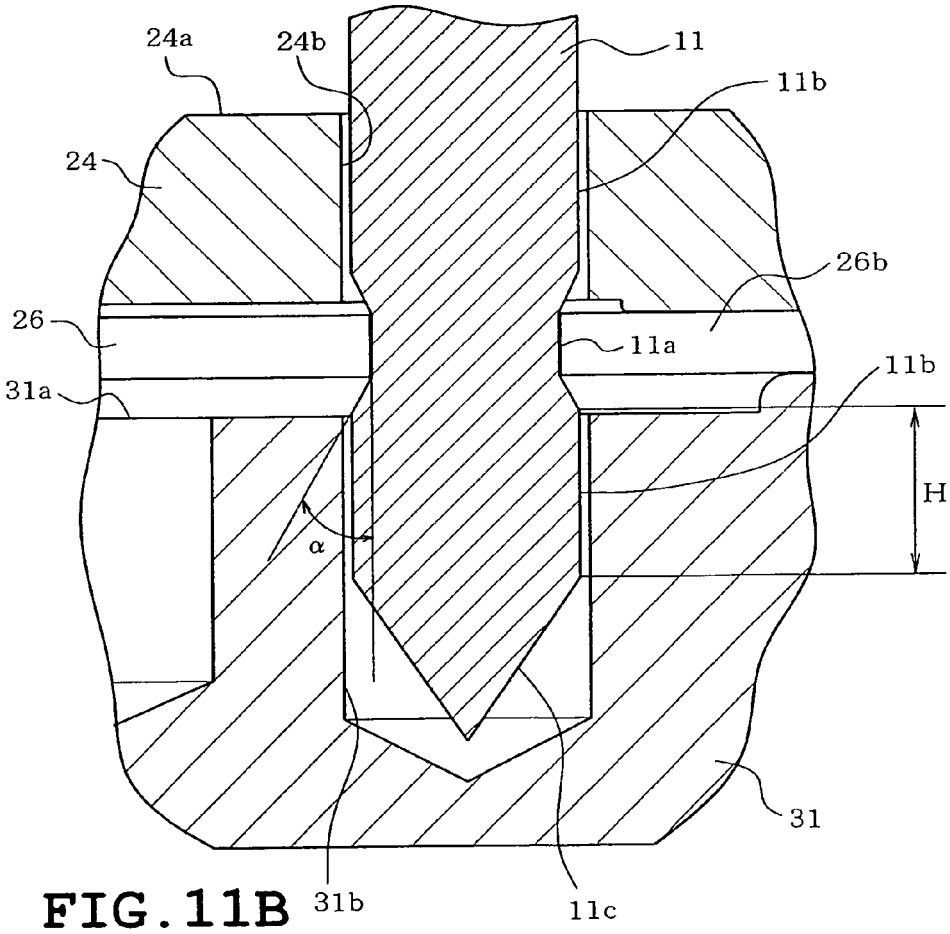
FIG. 11B is an enlarged longitudinal section showing the distal end of the cloth-fixing pin.
Figure 12:
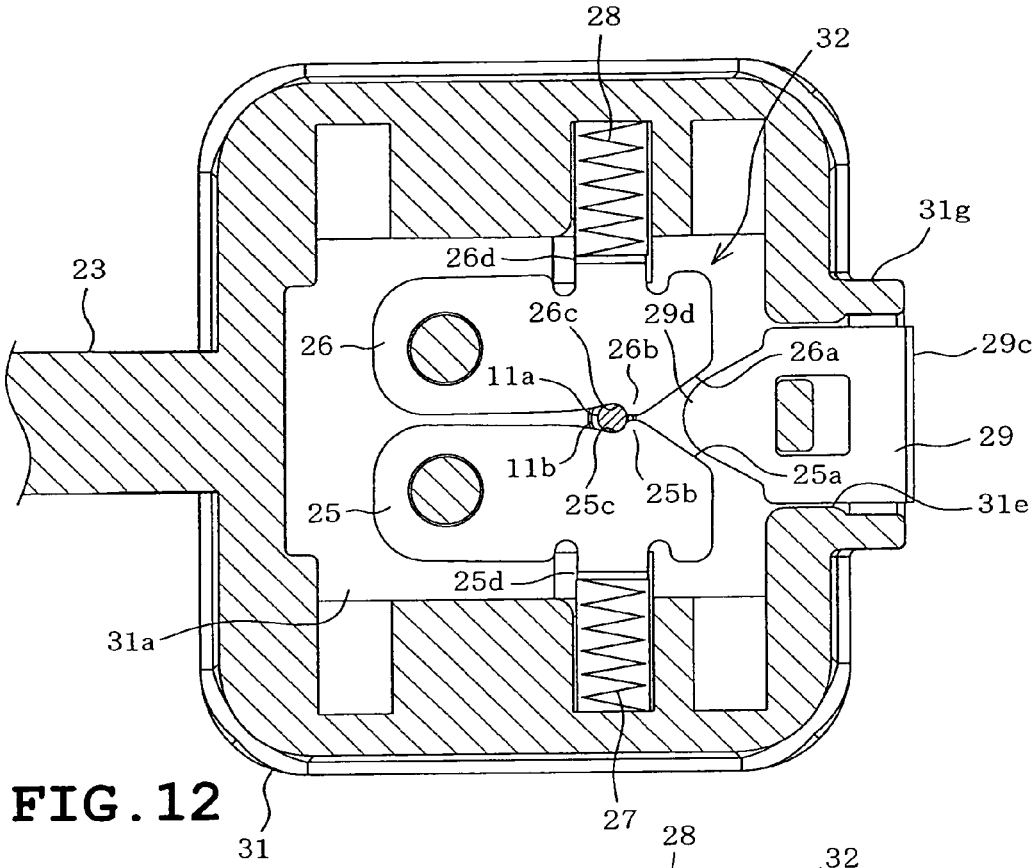
FIG. 12 is an enlarged cross section of the cloth-fixing pin taken along line XII-XII in FIG. 11A.

The cloth-fixing pin 11 includes a cylindrical portion 11*b* extending from the holder 35 and a conical portion 11*c* formed in a distal end of the cylindrical portion 11*b*. The cylindrical portion 11*b* includes a part that is located near the distal end thereof so as to be spaced from the conical portion 11*c*. The conical portion 11*c* is a pin tip of the pin 11 and is formed into a tapered shape that facilitates insertion of the cloth-fixing pin 11 into the through hole 24*b* and insertion hole 31*b*. The recess 11*a* is formed over an entire circumferential surface of the cylindrical portion 11*b*, for example. The recess 11*a* serves as an engagement portion that is detachably locked by the locking unit 32. The recess 11*a* has upper and lower sides thereof each of which is formed into tapered shape with a predetermined inclination, as shown in FIG. 11B. The taper inclination a is set so that the cloth-fixing pin can easily be inserted through and pulled out of the workpiece cloth CL and so that the recess 11*a* is reliably locked by the locking unit 32. Accordingly, the cloth-fixing pin 11 and the recess 11*a* are insertable through the workpiece cloth CL. Furthermore, a distance H between the recess 11*a* and the conical portion 11*c* is set so that the distal end of the cloth-fixing pin 11 is sufficiently held in the insertion hole 31*b*. On the other hand, the through hole 24*b* and insertion hole 31*b* of the cloth-fixing pin support 15 serve as receiving portions and have respective configuration to be fitted with an outer circumference of the cylindrical portion 11*b*. The distal end of the cloth-fixing pin 11 is supported at the outer circumference by the through hole 24*b* and the insertion hole 31*b*, whereby the cloth-fixing pin 11 is prevented from getting rickety. As a result, the cloth-fixing pin 11 is held at the recess 11*a* by the engagement claws 25 and 26 of the locking unit 32 and is further held by the through hole 24*b* and the insertion hole 31*b* of the cloth-fixing pin support 15 at portions of the cylindrical portion 11*b* located right above and below the recess 11*a*. FIG. 11B shows the cylindrical portion 11*b* inserted through the through hole 24*b* into the insertion hole 31*b* with a gap therebetween for the sake of clear showing. However, the cylindrical portion 11*b* is actually fitted in the through hole 24*b* into the insertion hole 31*b* with no space therebetween thereby to be held, whereupon the cloth-fixing pin 11 is prevented from getting rickety.

Figure 7A:
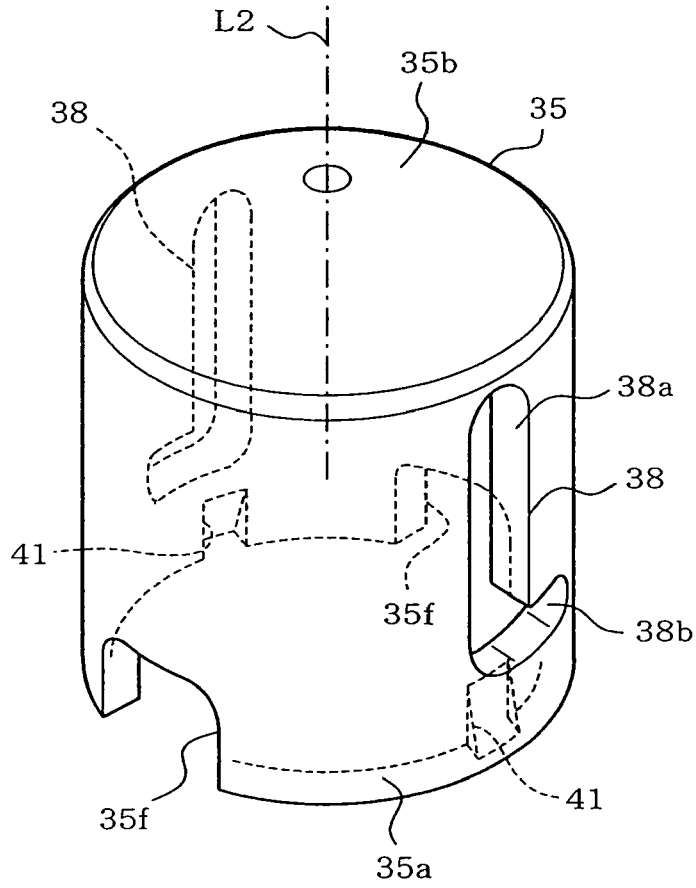
FIGS. 7A and 7B are a perspective view and a bottom view of a holder respectively.

The holder 35 is made from a synthetic resin and has a cylindrical portion 35*a* and a circular ceiling 35*b* both formed integrally therewith as shown in FIG. 7A. The holder 35 is generally formed into a cylindrical cap. The cylindrical portion 35*a* is provided with two guide grooves 38 each of which is notched generally into an L-shape. The L-shaped guide grooves 38 are formed in the circumference of the holder 35 so as to be symmetric about an axis L2 of the cylindrical portion 35*a* and so as to be spaced away from each other by 180°. Each guide groove 38 includes a vertical portion 38*a* extending vertically in parallel to the axis L2 and a horizontal portion 38*b* extending horizontally from a distal end of the vertical portion 38*a*. The cylindrical portion 35*a* has a lower end formed with two inverted U-shaped notches 35*f* into which lugs 40 are to be fitted respectively as will be described later. The notches 35*f* are formed in the circumference of the holder 35 so as to be symmetric about the axis L2 of the cylindrical portion 35*a* and so as to be spaced away from each other by 180°. The notches 35*f* and the guide grooves 38 are disposed alternately at intervals of 90°. A pair of radially outwardly recessed introducing portions 41 (see FIG. 7B) are provided in an inner circumference of the cylindrical portion 35*a* in order that a guide protrusion 39*b* of the covering member 36 may easily be assembled to the holder 35. The introducing portions 41 are inclined faces which are formed so as to extend upward from the lower end of the cylindrical portion 35*a* toward the guide grooves 38 respectively. Each introducing portion 41 has a width slightly larger than each guide groove 38.

Figure 7B:
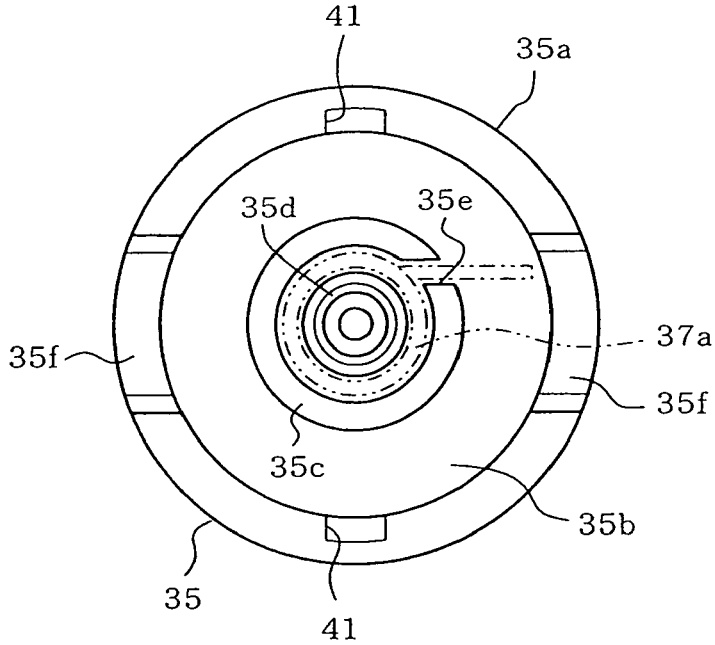
Figure 8A:
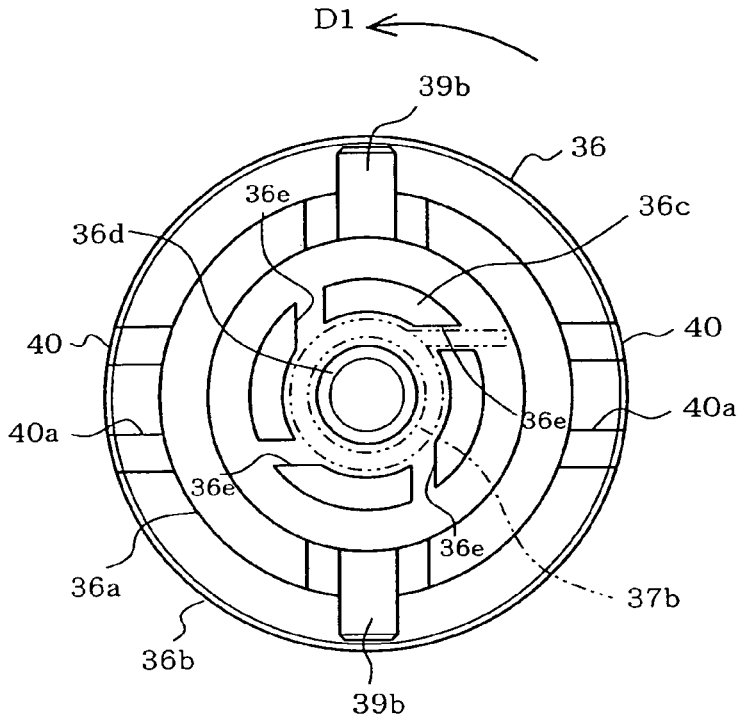
FIGS. 8A and 8B are an enlarged plan view of an enlarged perspective view of a covering member respectively.

A cylindrical spring hook 35*c* and a cloth-fixing pin 35*d* are formed to centrifugally protrude from a central portion of the circular ceiling 35*b*, as shown in FIG. 7B. The outer circumferential spring hook 35*c* has a partial notch 35*e* and is formed generally into a C-shape. A compression-torsion coil spring 37 as shown by two-dot chain line in FIG. 7B has an upper end 37*a* which is to be locked by the spring hook 35*c*. The cylindrical portion 11*b* has a proximal end which is secured to the inner circumferential pin fixing portion 35*d*.

Figure 8B:
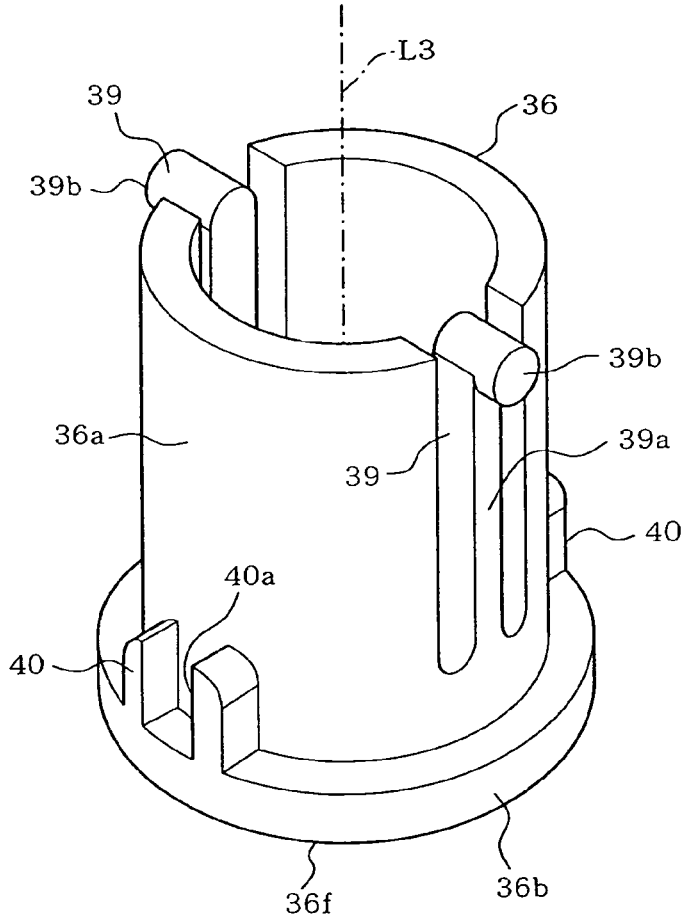
Figure 9C:
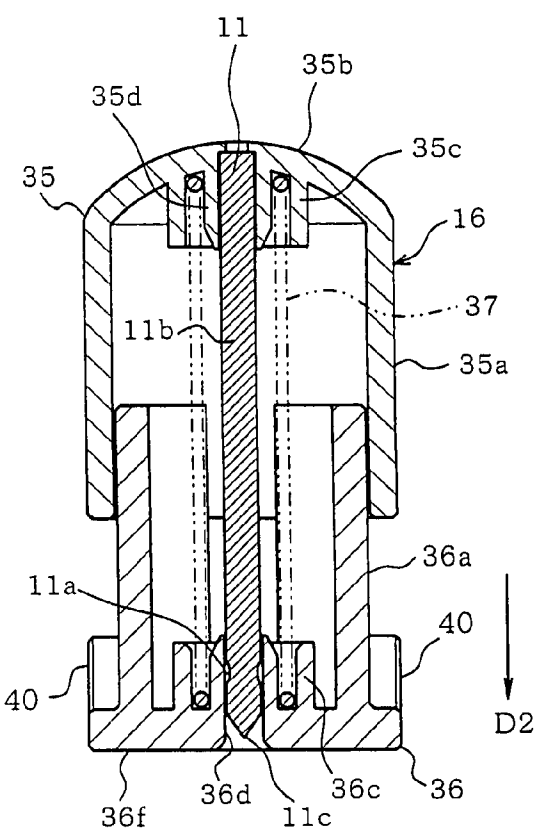
FIG. 9C is a sectional view taken along line IXc-IXc in FIG. 9B.
Figure 9B:
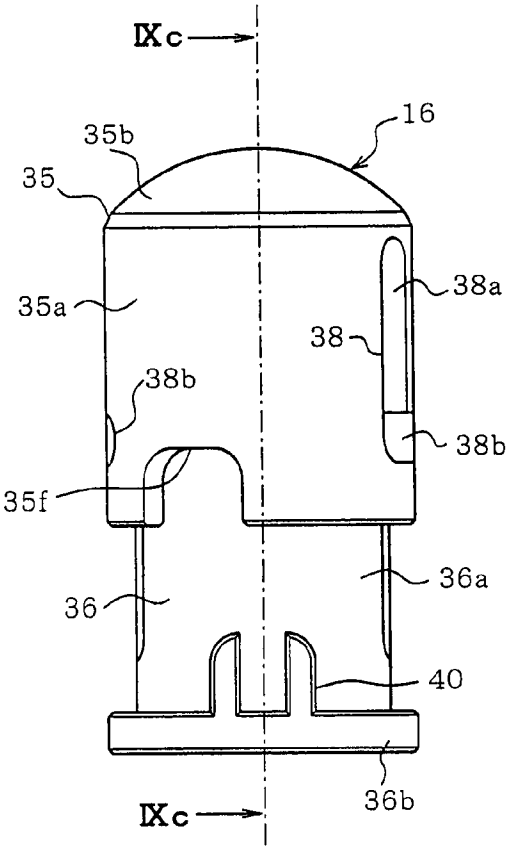
FIGS. 9A and 9B are a front view and a side view of the cloth fixing member while the covering member is located at a covering position, respectively.

The covering member 36 is made from a synthetic resin and includes a cylindrical trunk 36*a* and a flange 36*b* both of which are formed integrally therewith, whereby the covering member 36 is formed generally into a bottomed cylindrical shape, as shown in FIG. 8B. The trunk 36*a* is constructed so as to slide on an inner circumferential surface of the cylindrical portion 35*a* of the holder 35. The trunk 36*a* has a pair of guides 39 each of which guides the trunk 36*a* into the guide groove 38 of the holder 35. The guide 39 has a strip arm 39*a* formed by downwardly notching an upper end of the trunk 36*a* and a guide convex portion 39*b* which is formed on an upper end of the arm 39*a* and protrudes radially outward. The arm 39*a* and the guide convex portion 39*b* are formed integrally with the trunk 36*a*. The guides 39 are formed in the circumference of the covering member 36 so as to be symmetric about an axis L3 of the trunk 36*a* and so as to be spaced away from each other by 180°. An upper portion of each arm 39*a* is elastically deformable so as to be flexed inward until an outer side surface of the guide protrusion 39*b* and an outer circumferential surface of the trunk 36*a* are substantially coplanar due to the flexibility of the synthetic resin.

The trunk 36*a* has a lower end provided with a pair of lugs 40 which are grasped by the user with his/her fingers. Each lug 40 is formed so as to be fitted into the notch 35*f* of the holder 35. Each lug 40 is formed with a centrally located relief 40*a* recessed radially inward with respect to the trunk 36*a*. Each lug 40 connects between an outer circumference of the trunk 36*a* and an outer circumferential edge of a flange 36*b*. Each lug 40 is formed so that grip surfaces (outer peripheral surfaces) thereof and an outer circumference of the flange 36*b* are coplanar. The finger grips 40 are formed on the outer circumference of the holder 35 so as to be symmetric about the axis L3 and so as to be spaced away from each other by 180°. The finger grips 40 and the guides 39 and 38 are disposed alternately at intervals of 90°. Furthermore, the flange 36*b* is formed substantially into the shape of a circular plate and has an underside serving as a cloth presser 36*f* which presses the workpiece cloth CL.

The flange 36*b* has a centrally located cylindrical spring hook 36*c* and a pin insertion portion 36*d* both concentrically protruding from the bottom thereof as shown in FIG. 8A. The outer circumference side spring hook 36*c* has notches 36*e* formed at intervals of 90°. The spring hook 36*c* locks a lower end 37*b* of the compression-torsion coil spring 37 shown by two-dot chain line in FIG. 8A. The spring hook 36*c* has four notches 36*e*, and the notch 36*e* locking the lower end 37*b* is selectively changed from one to another, so that a torsional elastic force of the compression-torsion coil spring 37 can be changed. Furthermore, the cylindrical portion 11*b* of the cloth-fixing pin 11 is slidably inserted through the inner circumferential pin insertion portion 36*d*.

The covering member 36 is firstly fixed to and held by the holder 35 when assembled to the holder 35. Next, the holder 35 is turned, for example, by several turns against the torsional elastic force of the compression-torsion coil spring 37 in such a direction that an amount of torsion is increased, so that the holder 35 is retained at the location where the introducing portions 41 correspond with the guide protrusions 39*b* respectively. When the holder 35 is then thrust in downward against the elastic force of the compression-torsion coil spring 37 acting in the direction of compression, upper ends of the arms 39*a* are fitted into the respective guide grooves 38 while elastically deformed so as to be inwardly flexed. Subsequently, when the guide protrusions 39*b* reach the respective guide grooves 38, the upper ends of the inwardly flexed arms 39*a* return to former states such that the guide protrusions 39*b* are engaged with the respective guide grooves 38, whereby the assembly is completed. Thus, when the covering member 36 has been assembled to the holder 35, the guide protrusions 39*b* are guided along the vertical portions 38*a* of the guide grooves 38 so that the covering member 36 is movable between a covering location where the covering member 36 covers the circumference of the cloth-fixing pin 11 and an exposing location where the cloth-fixing pin 11 is uncovered to be exposed (see FIGS. 10A to 10C).

Figure 9A:
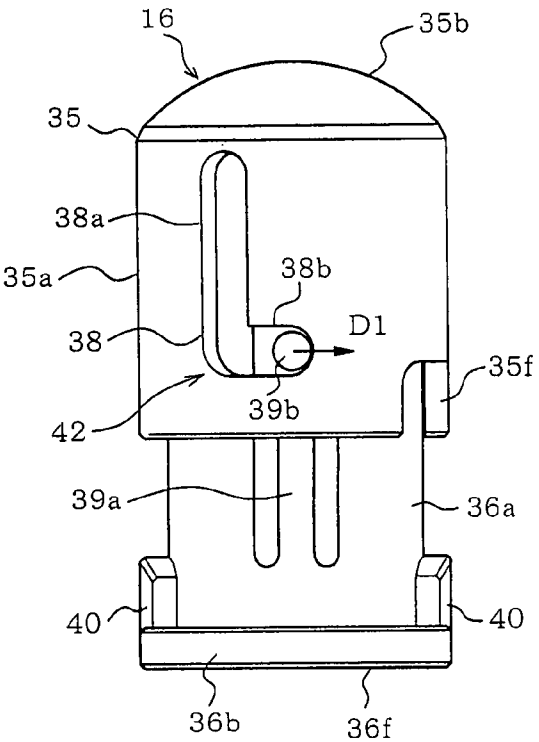
Figure 10C:
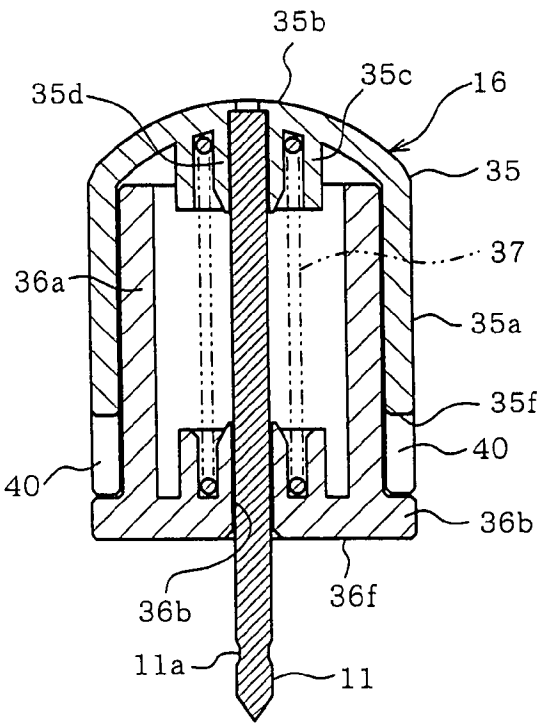
FIGS. 10A, 10B and 10C are views similar to FIGS. 9A, 9B and 9C, showing the cloth fixing member while the covering member is located at an exposure position, respectively.
Figure 10B:
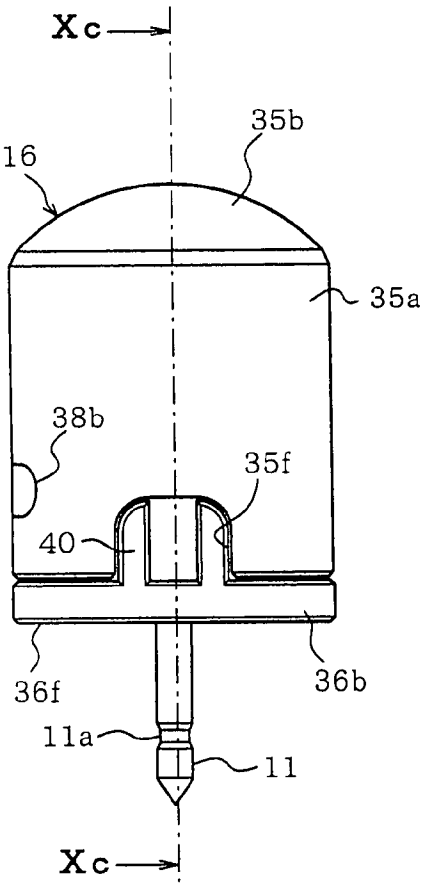
Figure 10A:
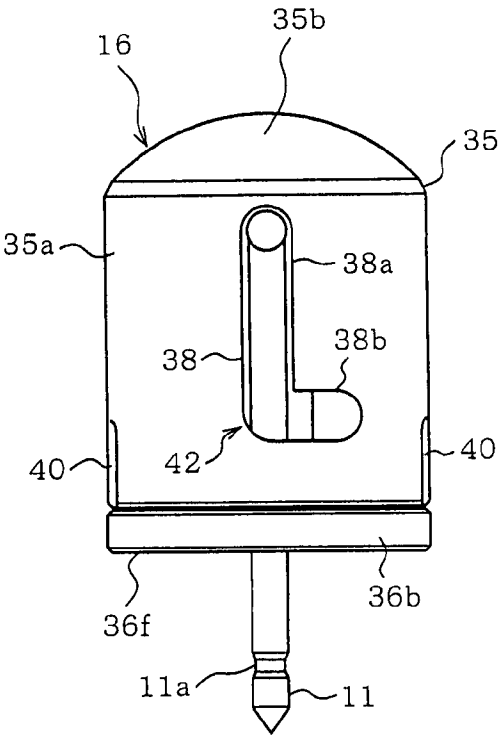

When having been assembled, the compression-torsion coil spring 37 (a first elastic member) is locked at the upper end 37*a* by the notch 35*e* of the spring hook 35*c* and is further locked at the lower end by the notch 36*e* of the spring hook 36*c* or selectively by one of the four notches 36*e*. The covering member 36 is urged in a direction of arrow D1 in FIGS. 8A and 9A or circumferentially relative to the holder 35 by the torsional elastic force of the compression-torsion coil spring 37. Furthermore, the covering member 36 is urged in a direction of arrow D2 in FIG. 9C or to the covering location side relative to the holder 35 by the compressive elastic force of the compression-torsion coil spring 37. Accordingly, the guide protrusion 39*b* of the covering member 36 is normally locked by the horizontal portion 38*b* of the guide groove 38 as shown in FIG. 9A. In this state, the covering member 36 is disallowed to be moved to the exposing location (the vertical movement relative to the holder 35). A switching mechanism 42 is constituted by the guide protrusion 39*b*, the horizontal portion 38*b* and the compression-torsion coil spring 37.

The operation of the circular stitching device 10 will now be described. When carrying out circular stitching, the user firstly fixes the mount 12*a* of the body base 12 to the needle plate 1*a* by the small screw 17 as shown in FIG. 2. When the cloth-fixing pin support 15 is detached from the movable base 13 in the case where the circular stitching device 10 is thus mounted on the upper surface of the needle plate 1*a*, the operating portion 19*a* of the operating plate 19 is pressed rearward against the elastic force of the compression coil spring 21 so that the operating plate 19 is moved rearward. As a result, the engagement claw 19*c* is disengaged from the engagement groove 23*b* rearward such that the cloth-fixing pin support 15 is released from the engagement with the operating plate 19. In this state, the cloth-fixing pin support 15 can be detached from the movable base 13 when lifted upward. Alternatively, the cloth-fixing pin support 15 may previously be detached before attachment of the circular stitching device 10 to the needle plate 1*a*.

Subsequently, the cloth-fixing pin 11 of the cloth fixing member 16 is inserted through the circular stitching center of the workpiece cloth CL. In this case, the covering member 36 is retained at the covering location by the switching mechanism 42, and the cloth fixing member 16 currently unused accommodates the cloth-fixing pin 11. The covering member 36 is then moved in a direction opposite the direction of arrow D1 (see FIG. 9A) relative to the holder 35 against the torsional elastic force of the compression-torsion coil spring 37. As the result of the aforesaid movement of the covering member 36, the guide protrusion 39*b* is located at the vertical portion 38*a* of the guide groove 38 and is thereafter pushed upward along the vertical portion 38*a*. In this case, the lugs 40 are fitted into the notches 35*f* of the holder 35 respectively when the covering member 36 occupies the exposing location (see FIG. 10B). When grasping the lugs 40, the user can easily insert the cloth-fixing pin 11 through the workpiece cloth CL against the compressive elastic force of the compression-torsion coil spring 37 while the covering member 36 is retained at the exposing location.

Subsequently, the cloth-fixing pin 11 inserted through the workpiece cloth CL is attached to the cloth-fixing pin support 15 having been detached from the movable base 13. As shown in FIG. 6, when the cloth-fixing pin 11 is not attached to the cloth-fixing pin support 15, the engagement claws 25 and 26 occupy respective such locations that the abutment portions 25*b* and 26*b* are in abutment with each other by the elastic forces of the compression coil springs 27 and 28. In this state, when inserted into the through hole 24*b* of the cloth-fixing pin support 15, the cloth-fixing pin 11 is moved downward while in sliding contact with the fitting portions 25*c* and 26*c* of the engagement claws 25 and 26. As a result, the gap between the engagement claws 25 and 26 is slightly spread. When the recess 11*a* of the cloth-fixing pin 11 has reached the fitting portions 25*c* and 26*c*, the cloth-fixing pin 11 is interposed between the engagement claws 25 and 26, thereby being supported (see FIG. 12). The parts of the cylindrical portion 11*b* located right above and below the recess 11*a* are retained by the through hole 24*b* and the insertion hole 31*b* of the cloth-fixing pin support 15 (see FIG. 11B). Accordingly, occurrence of backlash of the cloth-fixing pin 11 relative to the cloth-fixing pin support 15 is suppressed. Subsequently, when the user releases his/her hand from the lugs 40, the covering member 36 is moved downward by the compressive elastic force of the compression-torsion coil spring 37, thereby pressing the workpiece cloth CL onto the placement face 24*a* of the cloth-fixing pin support 15 by the cloth presser 36*f* thereof (see FIG. 11A).

Subsequently, the user moves the movable base 13 right and left to determine the location of the movable base 13 so that a desired circular stitching radius is obtained. The body base 12 may be provided with a scale giving an indication of location of the movable base 13. Subsequently, the cloth-fixing pin support 15 is attached to the movable base 13 while supporting the workpiece cloth CL and the cloth fixing member 16. The fitting convexity 23*a* is fitted into the fitting holes 20*a* and 18*c* of the upper and lower movable holders 20 and 18 form above, and the engagement portion 23*c* is fitted into the opening 20*b* of the upper movable holder 20. In this case, the engagement claw 19*c* of the operating plate 19 is engaged with the engagement groove 23*b* of the cloth-fixing pin support 15 by the elastic force of the compression coil spring 21 so that the cloth-fixing pin support 15 is prevented from falling off so as not to play or get rickety vertically relative to the movable base 13. Furthermore, both front and rear faces of the cloth-fixing pin support 15 are abutted against the inner surface of the paired cloth sliding portions 20*c* so that the cloth-fixing pin support 15 is supported so as not to fall in the front-rear direction. As a result, the workpiece cloth CL is locked at the circular stitching center thereof by the circular stitching device 10. The user can operate the sewing machine M to execute the circular stitching.

Figure 13:
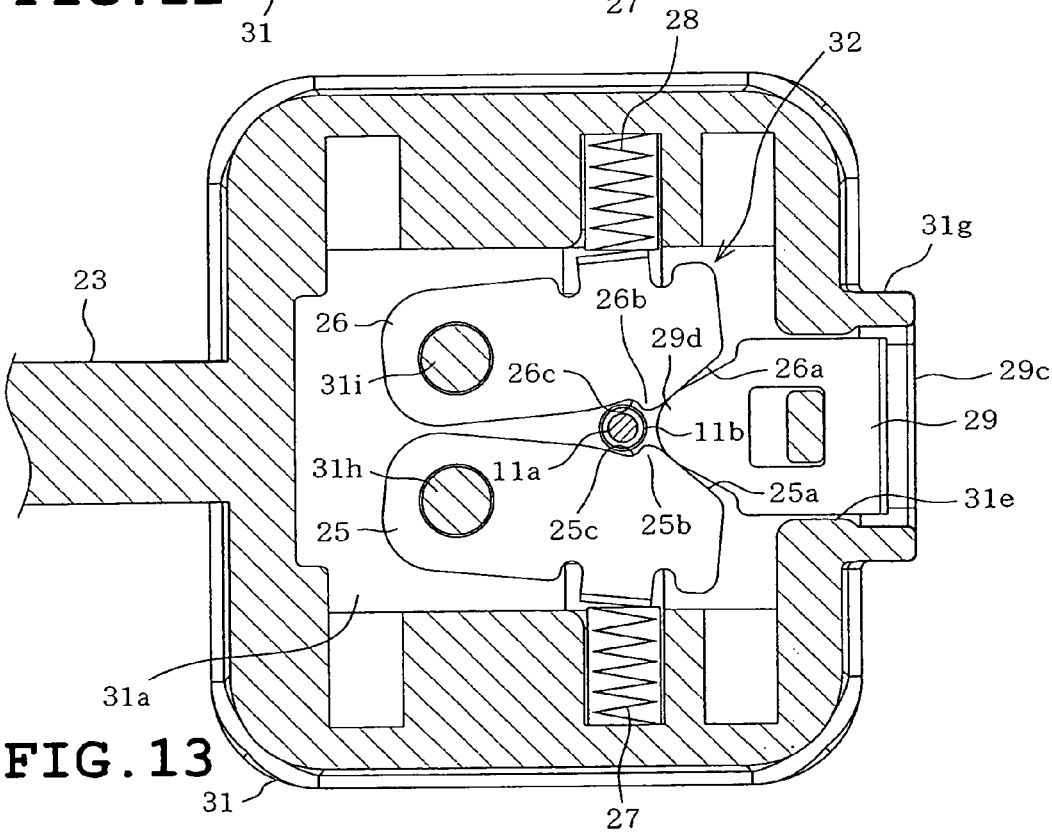
FIG. 13 is a view similar to FIG. 12A, showing the condition where the cloth-fixing pin has been released from the locking state effected by the locking means.

The pressing portion 29*c* of the operating plate 29 is pressed leftward in order that the cloth fixing member 16 may be detached from the cloth-fixing pin support 15. In this case, as shown in FIG. 13, while the angle spread portion 29*d* of the operating plate 29 is in sliding contact with the inclined portions 25*a* and 26*a*, the operating plate 29 is moved leftward to spread the engagement claws 25 and 26 so that an angle between the inclined portions 25*a* and 26*a* is increased against the elastic forces of the compression coil springs 27 and 28. As a result, the recess 11*a* of the cloth-fixing pin 11 is disengaged from the fitting portions 25*a* and 26*c* of the engagement claws 25 and 26, that is, the cloth-fixing pin support 15 is released from the locked state by the locking unit 32. In this state, the cloth fixing member 16 can be detached from the cloth-fixing pin support 15. Alternatively, firstly, the operating portion 19*a* of the operating plate 19 is pressed rearward so that the cloth-fixing pin support 15 is detached from the movable base 13 and thereafter, the cloth fixing member 16 may be detached from the cloth-fixing pin support 15. In this case, since the work of detaching the cloth fixing member 16 from the cloth-fixing pin support 15 is carried out at user's hand, a higher workability can be obtained.

When the cloth fixing member 16 has been detached from the cloth-fixing pin support 15, the covering member 36 is moved to the covering location side by the elastic force of the compression-torsion coil spring 37 thereby to cover the cloth-fixing pin 11. As a result, the safety can be ensured. Furthermore, when the guide protrusion 39*b* is locked by the horizontal portion 38*b* of the guide groove 38 (see FIG. 9A), the covering member 36 is switched so as to be immovable to the exposing location side. As a result, the covering member 36 can be handled in safety.

In the above-described circular stitching device 10, the cloth fixing member 16 having the cloth-fixing pin 11 is supported so as to be detachably attachable to the cloth-fixing pin support 15. Furthermore, the cloth-fixing pin support 15 is attachable to and detachable from the movable base 13. Accordingly, after the cloth-fixing pin support has been detached from the movable base 13, the cloth-fixing pin 11 can easily be attached to the cloth-fixing pin support 15 at user's hand while being inserted through the workpiece cloth CL at the circular stitching central location. Furthermore, the cloth fixing member 16 is attached to the cloth-fixing pin support 15 when the recess 11*a* of the cloth-fixing pin 11 is locked by the locking unit 32. When the recess 11*a* is disengaged from the locking unit 32, the cloth fixing member 16 is rendered detachable from the cloth-fixing pin support 15. Consequently, the cloth fixing member 16 can reliably be attached to and detached from the cloth-fixing pin support 15.

The cloth fixing member 16 comprises the covering member 36 which is movable between the covering location and the exposing location relative to the holder 35 and the compression-torsion coil spring 37 which elastically urges the covering member 36 to the covering location side. Accordingly, the cloth-fixing pin 11 can be covered by the covering member even during non-use of the circular stitching device 10 in which the cloth fixing member 16 is detached from the cloth-fixing pin support 15. In other words, the safety can be ensured since the user's finger can reliably be prevented from inadvertent touch with the distal end of the cloth-fixing pin.

The covering member 36 has the cloth presser 36*f* which downwardly presses the workpiece cloth CL by the elastic force of the compression-torsion coil spring 37 while the cloth-fixing pin 11 inserted through the workpiece cloth CL is locked by the locking unit 32 at the recess 11*a* thereof. Consequently, the workpiece cloth CL can be pressed by the cloth presser 36*f* so as not to float up, whereby the workpiece cloth CL can be turned desirably.

The locking unit 32 comprises the engagement claws 25 and 26 engaging the recess 11*a*, and the compression coil springs 27 and 28 elastically urging the engagement claws 25 and 26 in such a direction that the engagement claws 25 and 26 engage the recess 11*a*. Accordingly, the locking unit 32 can engage the engagement claws 25 and 26 with the recess 11*a* and maintain the engagement claws 25 and 26 in the engaging state by using the elastic forces of the compression coil springs 27 and 28. Consequently, the locking unit 32 can prevent the cloth-fixing pin 11 from getting rickety relative to the cloth-fixing pin support 15.

The engagement claws 25 and 26 are disposed so as to be opposed with the recess 11*a* being interposed therebetween. The engagement claws 25 and 26 are urged by the respective compression coil springs 27 and 28 in such a direction that the recess 11*a* is held between the engagement claws 25 and 26. Consequently, the recessed portion 11*a* of the cloth-fixing pin 11 can be held by the engagement claws 25 and 26, and reliably maintained in the engaged state.

The operating plate 29 is constructed so as to spread the gap between the engagement claws 25 and 26 against the elastic forces of the respective compression coil springs 27 and 28 thereby to disengage the engagement claws 25 and 26 from the recess 11*a*. Consequently, the engagement claws 25 and 26 can easily be disengaged from the recess 11*a* by operating the operating plate 29.

The covering member 36 has the lugs 40 which retain the exposing location against the elastic force of the compression-torsion coil spring 37. Thus, when the lugs 40 are grasped, the cloth-fixing pin 11 can be exposed from the covering member 36. Consequently, the cloth-fixing pin 11 can easily be inserted through the workpiece cloth CL at a desired circular stitching center, whereupon the usability of the circular stitching device 10 can be improved.

Furthermore, the cloth fixing member 16 is provided with the switching mechanism which switches the covering member 36 so that the covering member 36 is disallowed to be moved to the exposing location. Consequently, when the covering member 36 is switched so as to be immovable at the covering location, the cloth-fixing pin 11 can be prevented from being inadvertently exposed, whereupon the safety of the circular stitching device 10 during non-use can further be improved.

The cloth-fixing pin 11 includes the cylindrical portion 11*b* extending from the holder 35 and the conical portion 11*c* formed in the distal end of the cylindrical portion 11*b*. The recess 11*a* is formed in the part of the cylindrical portion 11*b* located near the distal end so as to be spaced away from the conical portion 11*c*. The cloth-fixing pin support 15 is provided with the insertion hole 31*b* (the receiving portion) supporting the portion of the cylindrical portion 11*b* located nearer to the distal end side than the recess 11*a* while the cloth-fixing pin 11 is locked by the locking unit 32. Consequently, since the cloth-fixing pin 11 is supported by the insertion hole 31*b* while being locked by the locking unit 32, the cloth-fixing pin 11 can reliably be prevented from getting rickety relative to the cloth-fixing pin support 15.

Figure 14A:
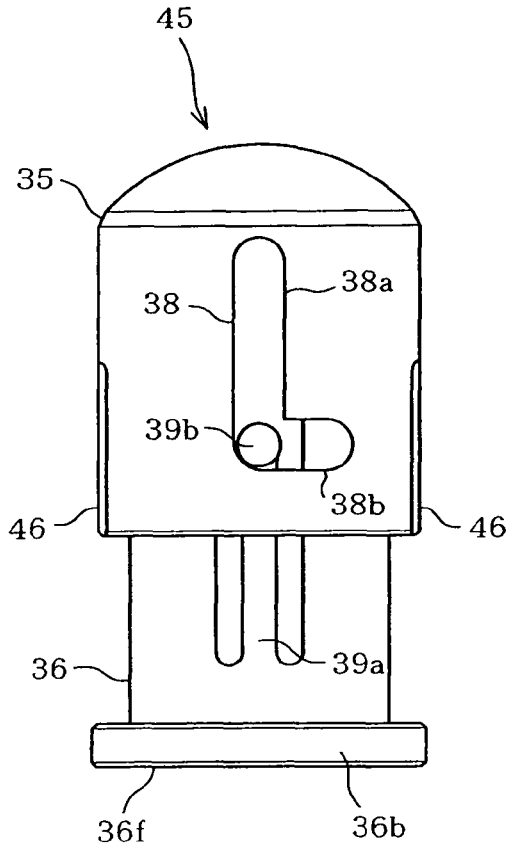
FIGS. 14A and 14B are a front view and a side view of the cloth fixing member in a second example respectively.
Figure 14B:
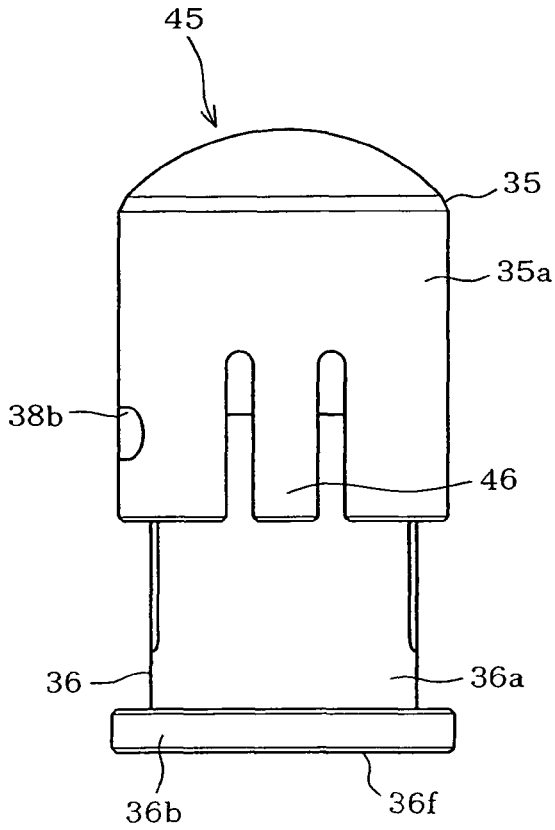

FIGS. 14A and 14B illustrate a second embodiment. The difference between the first and second embodiments will be described. In FIGS. 14A and 14B, identical or similar parts in the second embodiment are labeled by the same reference symbols as those in the first embodiment.

The cloth fixing member 45 in the second embodiment differs from the cloth fixing member 16 in the first embodiment as follows. No lugs 40 are provided on the covering member 36 side of the cloth fixing member 45. Lugs 46 are formed in the holder 35 instead of the notches 35*f*. Each lug 46 is formed into the shape of a strip by upwardly cutting out the lower end of the cylindrical portion 35*a*. Each lug 46 is grasped by the user with fingers. The lugs 46 and the guide grooves 38 are alternately disposed so as to be symmetrical about the axis L2 and so as to be spaced away from each other by 90°. The lugs 46 are disposed so as to be spaced away from each other by 180°.

When the user grasps the lugs 46 with the covering member 36 occupying the exposing location, the lower portions of the lugs 46 are inwardly flexed by the elasticity of the holder 35 made from a synthetic resin. In this case, lower inside surfaces of the lugs 46 are abutted against the outer circumferential surface of the trunk 36*a* of the covering member 36, so that the covering member 36 is maintained at the exposing location against the elastic force of the compression-torsion coil spring 37. Accordingly, since the cloth-fixing pin 11 is easily inserted through the workpiece cloth CL at the circular stitching center, the usability of the circular stitching device can be improved. Thus the second embodiment can achieve the same effect as the first embodiment.

Figure 15A:
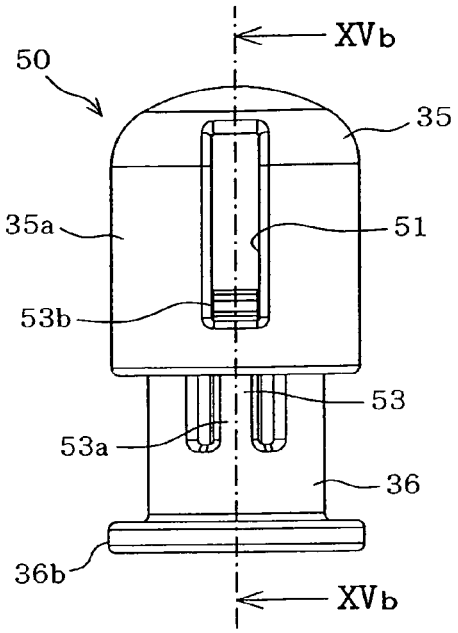
FIG. 15A is a front view of the cloth fixing member while the covering member is located at the covering position in a third example.

FIGS. 15A to 16B illustrate a third embodiment. The difference between the first and third embodiments will be described. In FIGS. 15A and 15B, identical or similar parts in the third embodiment are labeled by the same reference symbols as those in the first embodiment.

Figure 15B:
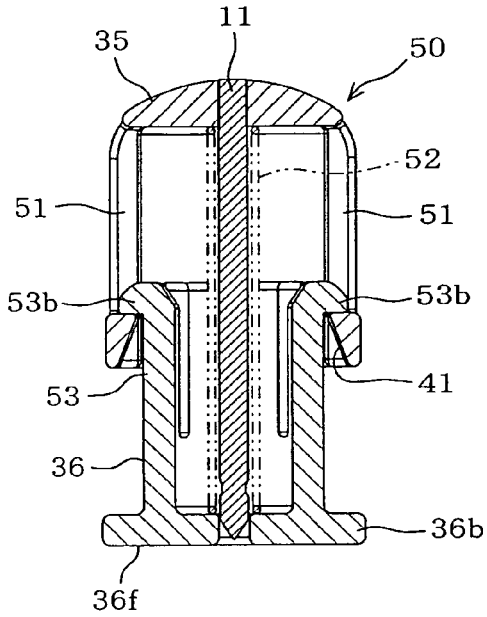
FIG. 15B is a sectional view taken along line XVb-XVb in FIG. 15A.
Figure 16A:
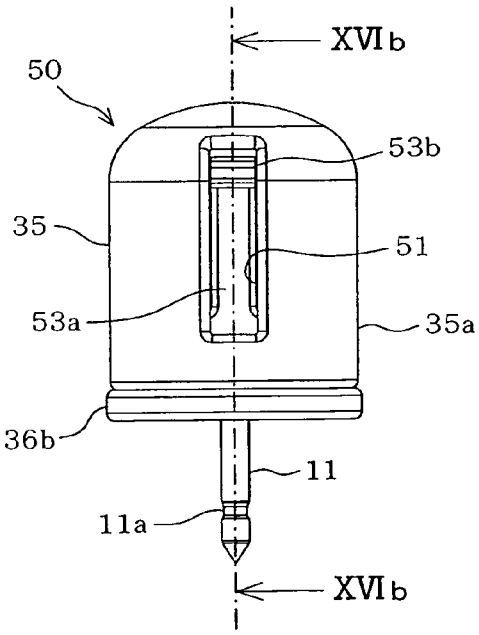
FIGS. 16A and 16B are views similar to FIGS. 15A and 15B in the condition where the covering member is located at the covering position, respectively.
Figure 16B:
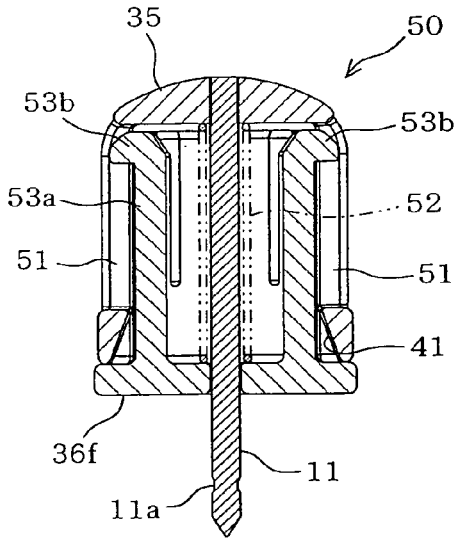

No lugs 40 are provided on the covering member 36 of the cloth fixing member 50. No notches 35*f* are formed in the holder 35. Furthermore, two vertically extending linear guide grooves 51 are formed in the holder 35 of the cloth fixing member 50, instead of the L-shaped guide groove. More specifically, the switching mechanism 42 is eliminated, and a compression coil spring (first elastic member) 52 is employed in the third embodiment. The spring hooks 35*c* and 36*c* are eliminated. The guide groove 51 is formed so as to have a slightly larger width than the vertical portion 38*a* of the guide groove 38. Accordingly, the guide portion 53 guided by the guide groove 51 has an arm 53*a* slightly wider than the guide 39 and a rectangular guide convexity 53*b*. The covering member 36 of the cloth fixing member 50 is constructed so as to be movable only vertically between the covering location (see FIGS. 15A and 15B) and the exposing location (see FIGS. 16A and 16B) relative to the holder 35. The introducing portions 41 are formed so as to be inclined so that the lower end sides of thereof are outwardly spread in order that the guide convexities 53*b* may easily be introduced during assembly of the covering member 36 to the holder 35, as shown in FIGS. 15B and 16B.

According to the above-described construction, the cloth-fixing pin 11 is normally covered by the covering member 36 when the covering member 36 is urged to the covering location side by the compression coil spring 52. Consequently, the usability of the circular stitching device 10 can be improved although the construction of the cloth fixing member 50 is rendered as simple as possible.

FIGS. 17A to 19C illustrate a fourth embodiment. The difference between the first and fourth embodiments will be described. FIG. 17B corresponds to the perspective view of FIG. 19A (showing the circular stitching device from which the cylindrical frame is removed as will be described later). In the figures, identical or similar parts in the fourth embodiment are labeled by the same reference symbols as those in the first embodiment.

Figure 17A:
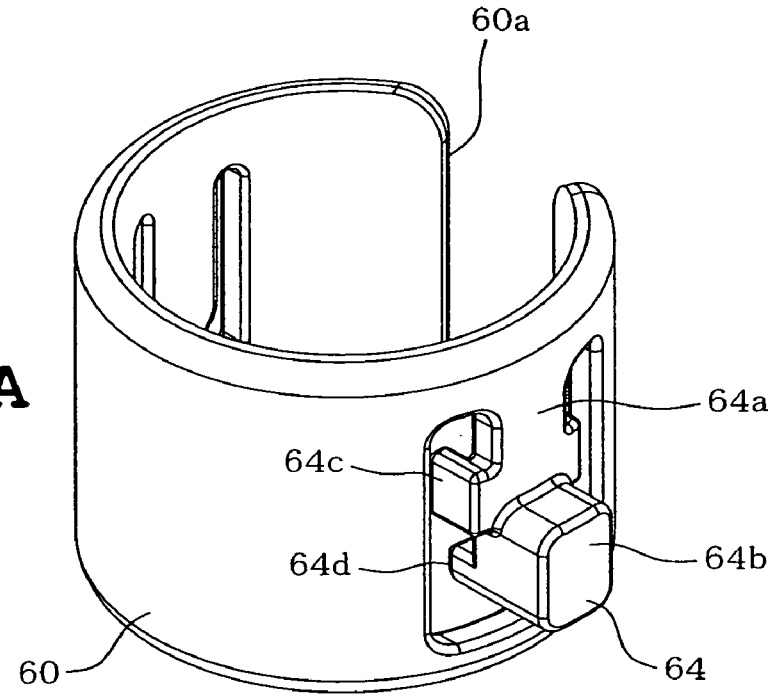
FIG. 17A is an enlarged perspective view of a cylindrical frame employed in the circular stitching device of a fourth example.
Figure 18C:
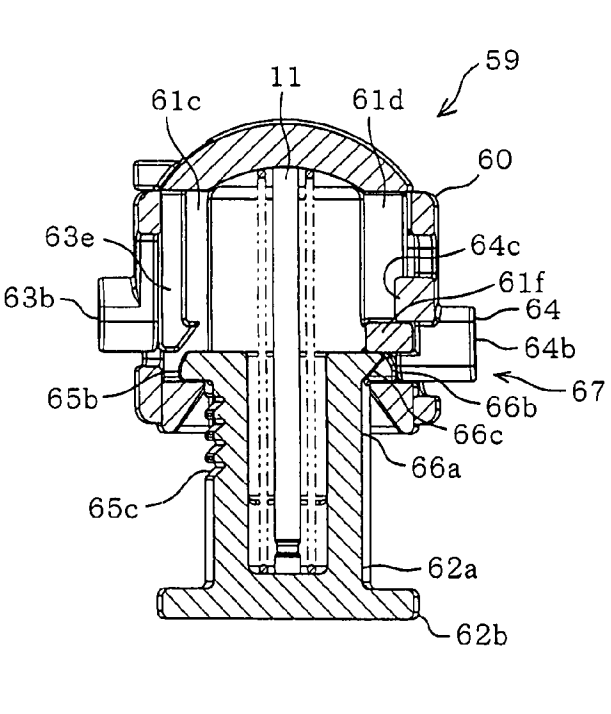
FIG. 18C is a sectional view taken along line XVIIIc-XVIIIc in FIG. 18A.
Figure 18B:
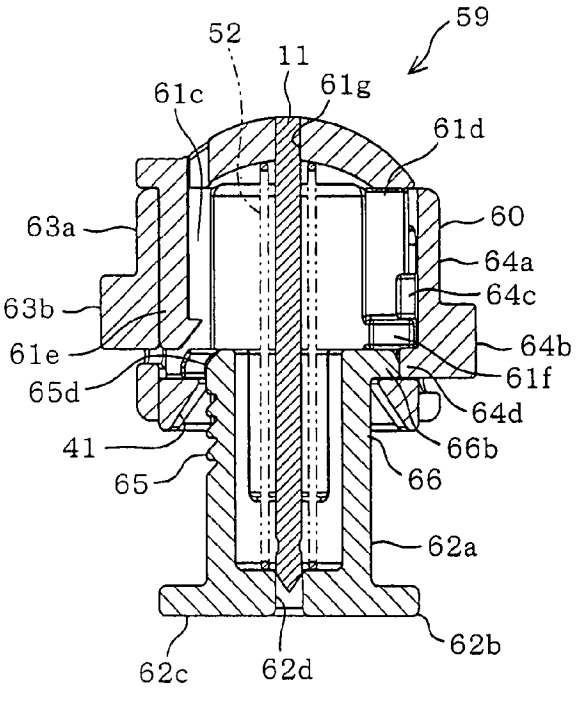
FIG. 18B is a sectional view taken along line XVIIIb-XVIIIb in FIG. 18A.
Figure 18A:
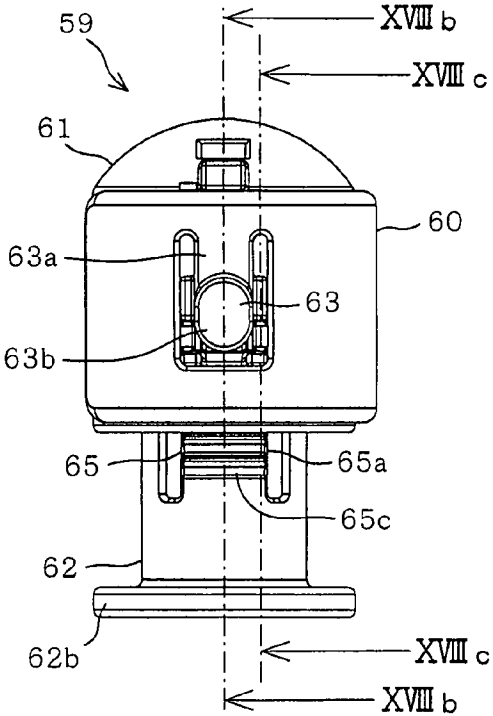
FIG. 18A is a front view of the cloth fixing member in the condition where the covering member is located at the covering position.
Figure 19C:
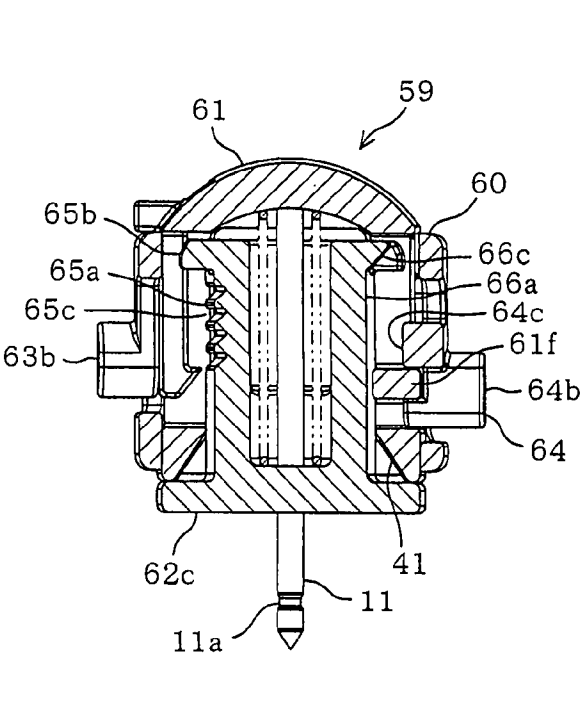
FIGS. 19A, 19B and 19C are views similar to FIGS. 18A, 18B and 18C in the condition where the covering member is located at the exposure position, respectively.
Figure 19B:
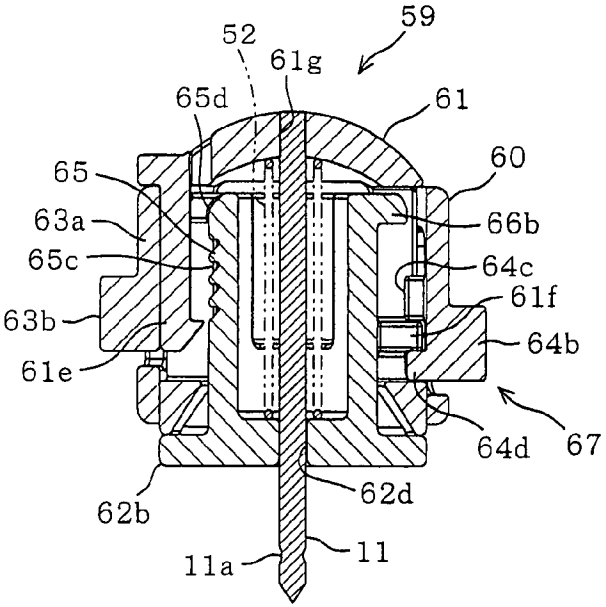
Figure 19A:
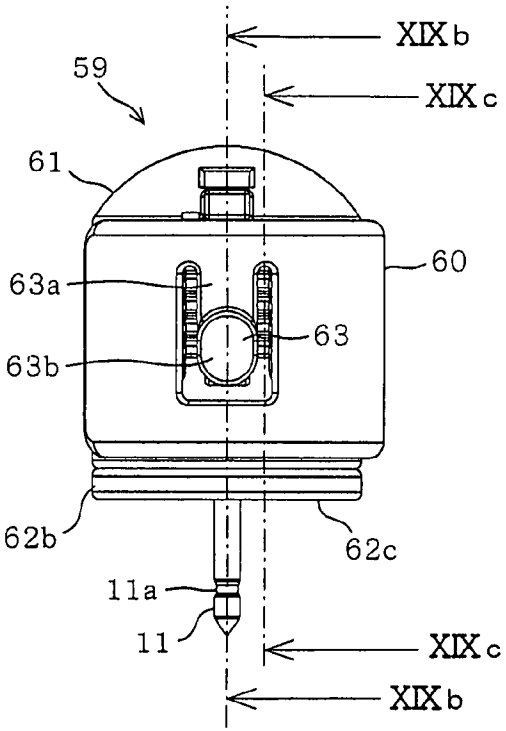

The cloth fixing member 59 in the fourth embodiment includes a cylindrical frame 60, a holder 61 which is disposed in the cylindrical frame 60, and a covering member 62 which is provided on the holder 61 so as to be movable between the covering location (see FIGS. 18A to 18C) and the exposing location (see FIGS. 19A to 19C). As shown in FIG. 17A, the cylindrical frame 60 is formed generally into a cylindrical shape and has an opening 60*a* formed by axially cutting out a part thereof. The cylindrical frame 60 includes a lug 63 which is grasped by the user with fingers thereby to be operated and a pressing portion 64 opposed to the lug 63.

The lug 63 includes a throat 63*a* formed by cutting out a part of the cylindrical frame 60 generally into a C-shape, and a lug body 63*b* which is formed on a lower end of the throat 63*a* so as to protrude radially outward, as shown in FIG. 18A. The throat 63*a* and the lug body 63*b* are formed integrally with the lug 63. Furthermore, as shown in FIG. 17A, the pressing portion 64 includes a throat 64*a* and a pressing portion body 64*b* which is formed on a lower end of the throat 64*a* so as to protrude radially outward, in the same manner as the lug 63. The throat 64*a* and the lug body 64*b* are formed integrally with the pressing portion 64. Furthermore, the pressing portion 64 is provided with first and second convexities 64*c* and 64*d* both protruding radially inward. When the lug body 63*b* is pressed, the lug 63 retains the cloth-fixing pin 11 in the exposed state against the elastic force of the compression coil spring 52 as will be described in detail later. When the pressing portion body 64*b* is pressed, the pressing portion 64 releases the covering member 62 from the engaged state at the covering location as will be described in detail later.

Figure 17B:
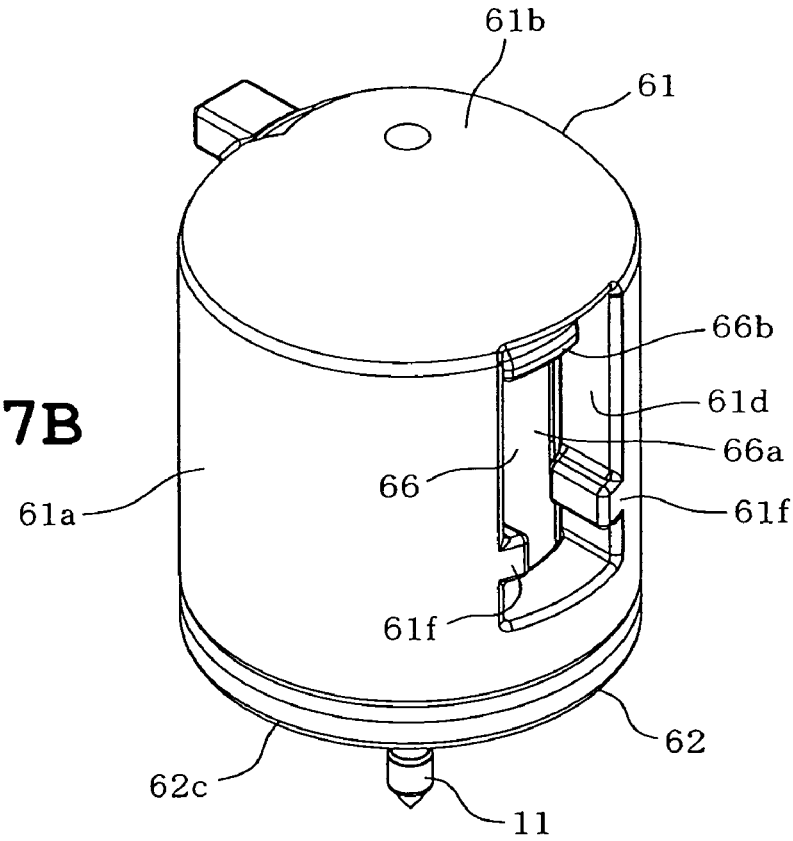
FIG. 17B is an enlarged perspective view in the condition where the covering member is assembled to a holder.

The holder 61 has a cylindrical portion 61*a* and circular ceiling 61*b* both formed integrally therewith and is formed into the shape of a cylindrical cap as a whole, as shown in FIG. 17B. The cylindrical portion 61*a* has a first guide groove 61*c* (see FIG. 18C) formed in a portion thereof facing the lug 63 and a second guide groove 61*d* formed in a portion thereof facing the pressing portion 64 when disposed in the cylindrical frame 60. The cylindrical portion 61*a* is provided with a locking claw 61*e* which is formed along the lug 63 so as to extend downward in the first guide groove 61*c*. Furthermore, the cylindrical portion 61*a* is also provided with a pair of locking portions 61*f* (see FIG. 17B) which are located on an edge of the second guide groove 61*d*. When the locking portion 61*f* is fitted in a space between the first and second convexities 64*c* and 64*d* of the pressing portion 64, the cylindrical portion 61*a* is fixed to the cylindrical frame 60. On the other hand, the circular ceiling 61*b* has a pin fixing portion 61*g* located on a central portion thereof. The pin fixing portion 61*g* holds a proximal end of a cylindrical column 11*b* of the cloth-fixing pin 11.

The covering member 62 includes a cylindrical trunk 62*a* and a flange 62*b* both formed integrally therewith as shown in FIGS. 18A to 19C. The covering member 62 is formed generally into the shape of a bottomed cylinder as a whole. The trunk 62*a* has an outer circumferential surface that is slid on an inner circumferential surface of the cylindrical portion 61*a* of the holder 61. The trunk 62*a* includes a first guide 65 which is guided into the first guide groove 61*c* of the holder 61 and a second guide 66 which is guided into the second guide groove 61*d* of the holder 61. Both guides 65 and 66 are formed so as to be wider than the guide 39 in the first embodiment. The first guide 65 has an arm 65*a* formed with a saw-tooth portion comprising a plurality of steps 65*c* and a guide convexity 65*b* which is formed on an upper end of the arm 65*a* so as to protrude radially outward. The arm 65*a* and the guide convexity 65*b* are formed integrally with the first guide 65.

The guide convexity 65*b* has a first escape 65*d* (see FIG. 18B) formed so as not to contact with the locking claw 61*e* of the holder 61 when the covering member 62 is vertically moved relative to the holder 61.

The second guide 66 has an arm 66*a* and a guide convexity 66*b* which is formed on an upper end of the arm 66*a* so as to protrude radially outward (see FIG. 17B). The arm 66*a* and the guide convexity 66*b* are formed integrally with the second guide 66. When the guide convexity 66*b* is locked by the underside of the locking portion 61*f* of the holder 61, the covering member 62 occupying the covering location is switched so as to be vertically immovable, as shown in FIGS. 18B and 18C. Furthermore, when the pressing member 64 is pressed while the covering member 62 occupies such a location that the outer circumference of the guide convexity 66*b* abuts against the inner circumference of the second convexity 64*d* of pressing portion 64, the covering member 62 is released from the locked state at the covering location. The guide convexity 66*b* has a second escape 66*c* (see FIG. 18C) formed so as to be allowed to be vertically moved relative to the locking portion 61*f*. The second escape 66*c* protrudes obliquely outward so that the guide protrusion 66*b* is smoothly moved downward relative to the locking portion 61*f* and so that the covering member 62 is retained in the locked state at the covering location. Accordingly, the switching mechanism 67 is composed of the locking portion 61*f*, the second guide 66 and the pressing member 64. The flange 62*b* has an underside which serves as a cloth presser 62*c* pressing the workpiece cloth CL. A pin inserting portion 62*d* is provided in a central part of the flange 62*b* as shown in FIG. 18B.

The cylindrical frame 60, the holder 61 and the covering member 62 are separate from one another and are each made from a synthetic resin with elasticity. Accordingly, when the pressing portion 64 or the lug 63 is pressed, the corresponding portion of the cloth fixing member 59 is flexed. More specifically, as shown in FIG. 18C, when an upper part of the guide convexity 66*b* is locked by the underside of the locking portion 61*f* of the holder 61 during non-use of the cloth fixing member 59, the covering member 62 is retained at the covering location. When the pressing portion body 64*b* of the pressing portion 64 is then pressed radially inward, the guide convexity 66*b* of the covering member 62 is thrust in by the second convexity 64*d* of the pressing portion 64. With this, the guide convexity 66*b* is released from engagement with the locking portion 61*f*.

In the above-described state, the covering member 62 is raised upward against the elastic force of the compression coil spring 52, thereby being movable to the exposing location side (see FIGS. 19A to 19C). Furthermore, in this case, the lug 63 and the locking claw 61*e* are flexed when the lug body 63*b* of the lug 63 is pressed radially inward. With the flexure of the lug 63 and the locking claw 61*e*, the distal end (the lower end) of the locking claw 61*e* is thrust in thereby to lock selected one of the steps 65*c* of the covering member 62. In this case, the length of the cloth-fixing pin 11 to be exposed can be adjusted since any one of the plural steps 65*c* is selectively locked by the locking claw 61*e*. Thus, when the user presses the lug 63 and grasps the cloth fixing member 59, the cloth-fixing pin 11 can be retained in the exposed state against the elastic force of the compression coil spring 52, and the cloth-fixing pin 11 can easily be inserted through the workpiece cloth CL.

On the other hand, when the lug 63 is released from the pressing force, the locking claw 61*e* is disengaged from the step 65*c* such that the covering member 62 is moved to the covering location side by the elastic force of the compression coil spring 52. In this case, since the second escape 66*c* is formed on the guide convexity 66*b* of the covering member 62, the guide convexity 66*b* is smoothly moved under the locking portion 61*f* thereby to be locked, whereupon the covering member 62 is retained in the immovable state at the covering location.

According to the above-described construction, the cloth fixing member 59 can be grasped by pinching the pressing portion 64 and the lug 63. Furthermore, the covering member 62 can be released from the locked state at the covering location only by the pressing force applied to the pressing portion 64, and the cloth-fixing pin 11 can be retained in the exposed state only by the pressing force applied to the lug 63. Since any one of the plural steps 65*c* is selectively locked by the locking claw 61*e*, the cloth-fixing pin 11 can be used with a desired length thereof to be exposed, whereupon the usability of the circular stitching device can be improved. Additionally, the covering member 62 can be switched by the switching mechanism 67 so as to be immovable to the exposing location side. The fourth embodiment thus achieves substantially the same effect as the first embodiment.

The foregoing embodiments should not be restrictive but may be modified or expanded as follows. The locking unit 32 should not be limited to the two engagement claws 25 and 26. One, three or more locking units may be provided, instead. Furthermore, the cloth-fixing pin 11 needs to be insertable through the workpiece cloth CL and to have the engagement portion disengageably engaged by the locking unit 32. Thus, the engagement portion should not be limited to the recess 11*a*. Thus, one or a plurality of recesses may be formed in the outer circumferential edge of the cylindrical portion 11*b*, instead of the recess 11*a* formed over the entire circumference of the cylindrical portion 11*b*. Additionally, the cloth-fixing pin 11 should not be limited to the shape as shown in the figures. The distance H between the recess 11*a* and the conical portion 11*c*, the inclination a and the like may be changed.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A circular stitching device for a sewing machine which executes a circular stitching while a workpiece cloth is turned about a cloth-fixing pin having passed through a workpiece cloth from above at a lateral position spaced away from a needle point by way of cloth feed by a feed dog, the circular stitching device comprising:

a body base which is attachable to a sewing bed or an upper surface of a needle plate;

a movable base which is provided on the body base so as to be movable in a predetermined direction;

a cloth fixing member which includes the cloth-fixing pin which is passable through a workpiece cloth and is formed with an engagement portion, and a holder holding a proximal end of the cloth-fixing pin;

a cloth-fixing pin support which is detachably attachable to the movable base thereby to support the cloth fixing member so that the cloth fixing member is detachably attachable thereto; and a locking unit which is provided on the cloth-fixing pin support and is disengageably engageable with the engagement portion of the cloth-fixing pin, thereby locking the cloth-fixing pin.

2. The circular stitching device according to claim 1, wherein the cloth fixing member includes a covering member which is provided on the holder so as to be movable between a covering position where the covering member covers a periphery of the cloth-fixing pin and an exposing position where the cloth-fixing pin is exposed and a first elastic member which elastically urges the covering member toward the covering position.

3. The circular stitching device according to claim 2, wherein the covering member includes a cloth pressing portion which downwardly presses the workpiece cloth by an elastic force of the first elastic member while the cloth-fixing pin having passed through the workpiece cloth is locked at the engagement portion thereof by the locking unit.

4. The circular stitching device according to claim 1, wherein the engagement portion is a recess formed in the cloth-fixing pin, and the locking unit includes an engaging claw which engages the recess and a second elastic member which elastically urges the engaging claw in such a direction that the engaging claw engages the recess.

5. The circular stitching device according to claim 4, wherein a plurality of the engaging claws are disposed at respective locations opposed to each other with the recess being interposed therebetween, and the second elastic member urges the engaging claws in such directions that the engaging claws interpose the recess respectively.

6. The circular stitching device according to claim 4, further comprising an operating portion which disengages the engaging claw and the recess from each other, wherein the operating portion increases a clearance between the engaging claws against an elastic force of the second elastic member when operated.

7. The circular stitching device according to claim 2, wherein the covering member has a lug which maintains the covering member at the exposing position against an elastic force of the first elastic member.

8. The circular stitching device according to claim 2, further comprising a switching mechanism which switches the covering member so that the covering member is disallowed to be movable relative to the holder.

9. The circular stitching device according to claim 4, wherein:

the cloth-fixing pin has a cylindrical portion extending from the holder and a conical portion formed on a distal end of the cylindrical portion;

the recess is formed in a portion of the cylindrical portion near the distal end thereof so as to be spaced away from the conical portion; and the cloth-fixing pin support includes a receiving portion which supports a part of the cylindrical portion located nearer to the distal end side than the recess of the cylindrical portion when the cloth-fixing pin is locked by the locking unit.

* * * * *